US008291530B2

(12) United States Patent
Burkholder et al.

(10) Patent No.: US 8,291,530 B2
(45) **Date of Patent: *Oct. 23, 2012**

(54) INFANT SLEEPING APPARATUS AND CHILD CONTAINMENT SYSTEM

(75) Inventors: Brandon Burkholder, Atlanta, GA (US); Matt Rivera, Mableton, GA (US); Annette Stella, Downingtown, PA (US)

(73) Assignee: Graco Children's Products Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/178,340

(22) Filed: Jul. 7, 2011

(65) Prior Publication Data

US 2011/0258775 A1 Oct. 27, 2011

Related U.S. Application Data

(63) Continuation of application No. 12/113,552, filed on May 1, 2008, now Pat. No. 8,001,630.

(60) Provisional application No. 61/014,053, filed on Dec. 16, 2007, provisional application No. 60/927,349, filed on May 3, 2007.

(51) Int. Cl.
*A47D 7/00* (2006.01)

(52) U.S. Cl. ..... 5/93.1; 5/98.1

(58) Field of Classification Search ..... 5/93.1, 5/93.2, 97, 98.1, 98.2, 98.3, 99.1, 100, 101, 5/102, 94, 95, 655

See application file for complete search history.

(56) References Cited

U.S. PATENT DOCUMENTS

| | | | | |
|---|---|---|---|---|
| 234,016 | A | 11/1880 | Fosburgh | |
| 2,260,584 | A | 10/1941 | Schuck et al. | |
| 5,274,863 | A | 1/1994 | Fountain | |
| 5,867,850 | A | 2/1999 | Mariol | |
| 6,539,563 | B1 | 4/2003 | Hsia | |
| 6,550,083 | B1 * | 4/2003 | LaMantia | 5/97 |
| 6,735,796 | B2 * | 5/2004 | Warner et al. | 5/99.1 |
| 7,055,191 | B1 | 6/2006 | Chen | |
| 7,203,981 | B1 | 4/2007 | Cowgill | |
| 7,263,729 | B2 | 9/2007 | Paesang et al. | |
| 2002/0078499 | A1 | 6/2002 | Cheng | |
| 2006/0207023 | A1 | 9/2006 | DeHart et al. | |
| 2006/0218725 | A1 | 10/2006 | Carpenter | |
| 2006/0225205 | A1 | 10/2006 | Troutman | |
| 2006/0253980 | A1 | 11/2006 | Paesang et al. | |

OTHER PUBLICATIONS

Photograph of Century Products' Crib Cuddle II (admitted prior art).

(Continued)

*Primary Examiner* — Robert G Santos
*Assistant Examiner* — Nicholas Polito
(74) *Attorney, Agent, or Firm* — Lempia Summerfield Katz LLC

(57) ABSTRACT

A child containment system has a child containment structure with a bottom, a perimeter side wall surrounding the bottom, and a connector part carried on each of two opposed inward facing surfaces of the perimeter wall. The system has an infant sleeping apparatus with a fabric panel having a top surface, a perimeter edge, a frame structure carrier near the perimeter edge, and an exposed portion of the frame structure positioned near each opposed end of the fabric panel. The infant sleeping apparatus is removably mounted to the child containment structure with the fabric panel suspended above the bottom of the child containment structure by connecting each exposed portion of the frame structure to a corresponding one of the connector parts of the child containment structure.

16 Claims, 19 Drawing Sheets

OTHER PUBLICATIONS

Product information for Fisher-Price Baby Papasan Infant Seat from www.fisher-price.com (2007).

European Search Report issued in related European patent application No. 08251608.9 mailed Aug. 28, 2008.

* cited by examiner

INFANT SLEEPING APPARATUS AND CHILD CONTAINMENT SYSTEM

RELATED APPLICATION DATA

This patent application is a continuation of application Ser. No. 12/113,552 filed on May 1, 2008 and entitled "Infant Sleeping Apparatus and Child Containment System," which is hereby incorporated by reference herein in its entirety and which claimed priority to U.S. provisional patent application Nos. 61/014,053 filed on Dec. 16, 2007 and entitled "Infant Sleeping Apparatus," and 60/927,349 filed on May 3, 2007 and entitled "Sleeping Apparatus," each of which is also incorporated herein by reference.

BACKGROUND OF THE INVENTION

1. Field of the Disclosure

The present disclosure is generally directed to a sleeping apparatus for infants, and more particularly to such a sleeping apparatus that is attachable or mountable to a playard or other child containment structure.

2. Description of Related Art

Playards and other child containment structures typically have a frame structure supporting a fabric enclosure and defining a play or sleeping surface at the bottom of the structure. The side walls of a playard are typically rather tall to contain a child or toddler within the playard as they sleep or play. A toddler can stand up so that a caregiver can grasp and lift the child out of the playard without having to reach over the side walls all the way down to the bottom surface. For newborns and infants, using the standard playard bottom surface for a napping or sleeping apparatus is less convenient because the infant can't stand up. Thus, the caregiver has to reach over the side wall all the way down to the bottom playard surface to place the infant in, or to retrieve the infant from, the playard. This can be difficult and strenuous for many caregivers.

Sleeping devices for infants have been configured in the form of bassinets that can be suspended from the top rails of a playard frame structure above the playard's bottom surface. However, this type of bassinet is typically a rectangular box shape, which does not provide a particularly soothing or comforting sleeping environment for newborns and infants. This type of bassinet in one example has a plurality of elongate hooks or clips that have an inverted U-shape in cross section and that are hooked onto and hang from the top rails of the playard frame structure. The box-shaped bassinet bed hangs from the clips. Changing table devices are also known that are mountable to the playard frame, some in a manner similar to the bassinet, and that provide an area for diaper changing.

Another known infant sleeping device produced by Fisher-Price has a sleeping surface supported by a discrete frame that sits on the ground. The resting or sleeping surface of the device has a substantial incline and thus requires a harness to secure the child in place. Also, this sleeping device places the sleeping surface, and thus the infant, near the ground requiring the caregiver to bend over significantly to place the child in or retrieve the child from the device. This device is substantially similar to an infant bouncer seat.

In another example, an apparatus is known that includes a soft material providing a hammock-like sleeping surface that has tie or strap connectors disposed about its periphery. The connectors can be attached, for instance, to the top rails of a crib (see FIG. 11 herein). However, the connectors require that portions of the top rail periphery on the crib be entirely unobstructed around the rails' circumference because the connectors must loop around the crib rails. A typical playard has fabric suspended from the frame structure obstructing its top rails. As a result, this known apparatus is not suitable for use on a playard. Installation of this hammock-like sleeping apparatus can also take significant time and effort because each individual connector must be individually wrapped around the rail and attached separately. In addition, there are no end connectors to further stabilize the sleeping surface. The only connectors of this prior known sleeping apparatus are found on the sides of the fabric material.

Caregivers have been known to place an infant into a bouncer seat or a car seat, secure them in the seat, and then place that seat into the playard for a more comforting or soothing sleeping or napping environment. The bodily movement required of the caregiver can be cumbersome, difficult, and even risk injury. The seat must be placed on the bottom surface of the enclosure or playard structure, which can be cumbersome and place undue stress on the caregiver's back, particularly if the infant is already secured in the seat.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Figure 1:
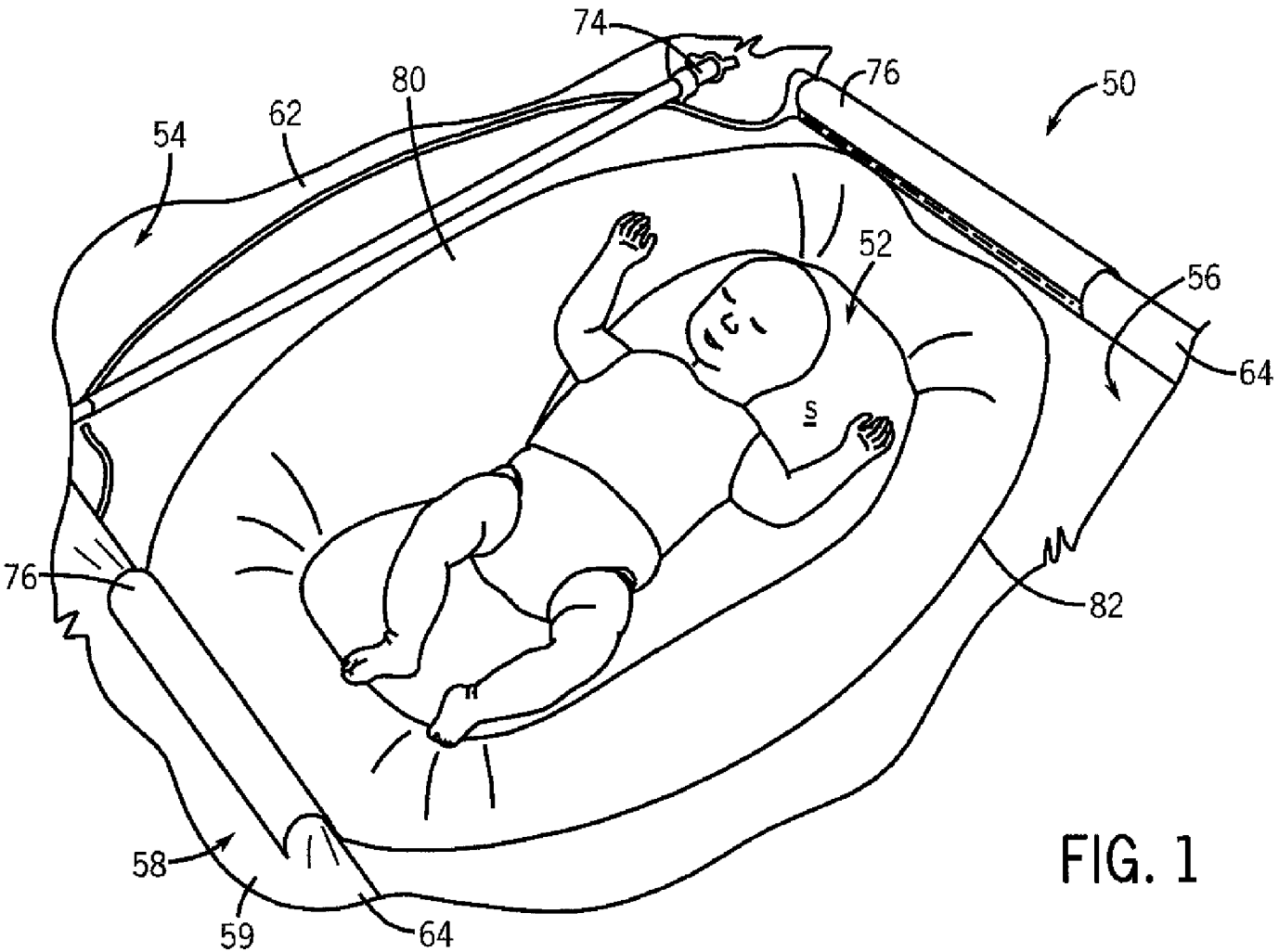
FIG. 1 shows a perspective view of one example of an assembled infant sleeping apparatus in accordance with the teachings of the present invention and installed on a bassinet within a playard.

The inventors have recognized an absence of a safe and soothing sleeping or napping area for infants that can also be readily, conveniently, and easily installed and utilized by the caregiver. The inventors have identified that a sleeping surface or apparatus is needed that can be readily and easily attached to an existing playard frame or other child containment enclosure or structure. The inventors have determined that such a sleeping apparatus would be beneficial if it provided a more "womb-like," soothing, enveloping environment for the infant. The inventors have also determined that such an apparatus would be advantageous if it mounted easily to the top rails of a playard frame or other structure for easy and ready access by a caregiver. The inventors have also identified a need for a sleeping apparatus that provides a safe sleeping surface for the infant as well. The inventors have thus developed a number of alternative sleeping apparatus designs that can also be mounted to a conventional playard directly above a bassinet already mounted to the playard.

A sleeping apparatus or napping surface is disclosed herein that solves or improves upon one or more of the above-noted problems and/or disadvantages in the prior art. The disclosed apparatus examples provide a sleeping area for an infant that can be positioned within and supported by a playard. The disclosed apparatus examples are attachable to a part of the playard and are configured to snuggly envelop a newborn or infant, similar to a hammock, to create a comforting "womb-like" environment for napping or sleeping. The disclosed apparatus examples can also mount to a bassinet that has already been installed on a playard frame structure. Thus, the bassinet sleeping surface beneath the disclosed apparatus examples can create a "safety net" directly beneath the napping or sleeping surface of the disclosed apparatus examples.

Turning now to the drawings, FIGS. 1-10 illustrate one example of an infant sleeping system 50 constructed in accordance with the teachings of the present invention. In this example, the system 50 in FIG. 1 generally has an infant sleeping apparatus 52 mounted to and supported by a playard 54 and directly above a bassinet 56 installed on the playard. As is known in the art, a playard 54, as in FIGS. 1, 3, and 4, conventionally has a bottom as part of a base structure 57 that creates a play or sleeping surface surrounded by side walls 58. Together, the base structure 57 and the side walls 58 define a child containment enclosure for an infant or toddler.

The side walls 58 of a typical playard 54 are generally formed of a fabric and mesh material 59 suspended from and supported by top rails of a frame structure. In the disclosed example, the frame structure of the playard 54 is rectangular and has four corner posts 60 extending upward from the base structure 57 at corners of the playard. A top end rail 62 is positioned interconnecting the corner posts 60, near their respective top ends, at each opposite end of the playard 54. Similarly, a top side rail 64 is positioned interconnecting the corner posts 60, near their respective top ends, along the opposed sides of the playard. As will be evident to those having ordinary skill in the art, the frame structure and overall configuration of the playard 54 described herein can vary from the example shown and yet fall within the spirit and scope of the present invention. The disclosed infant sleeping apparatus 52 can thus vary according to changes and modifications made to the child containment structure or playard for which the apparatus is intended to be used.

Figure 2:
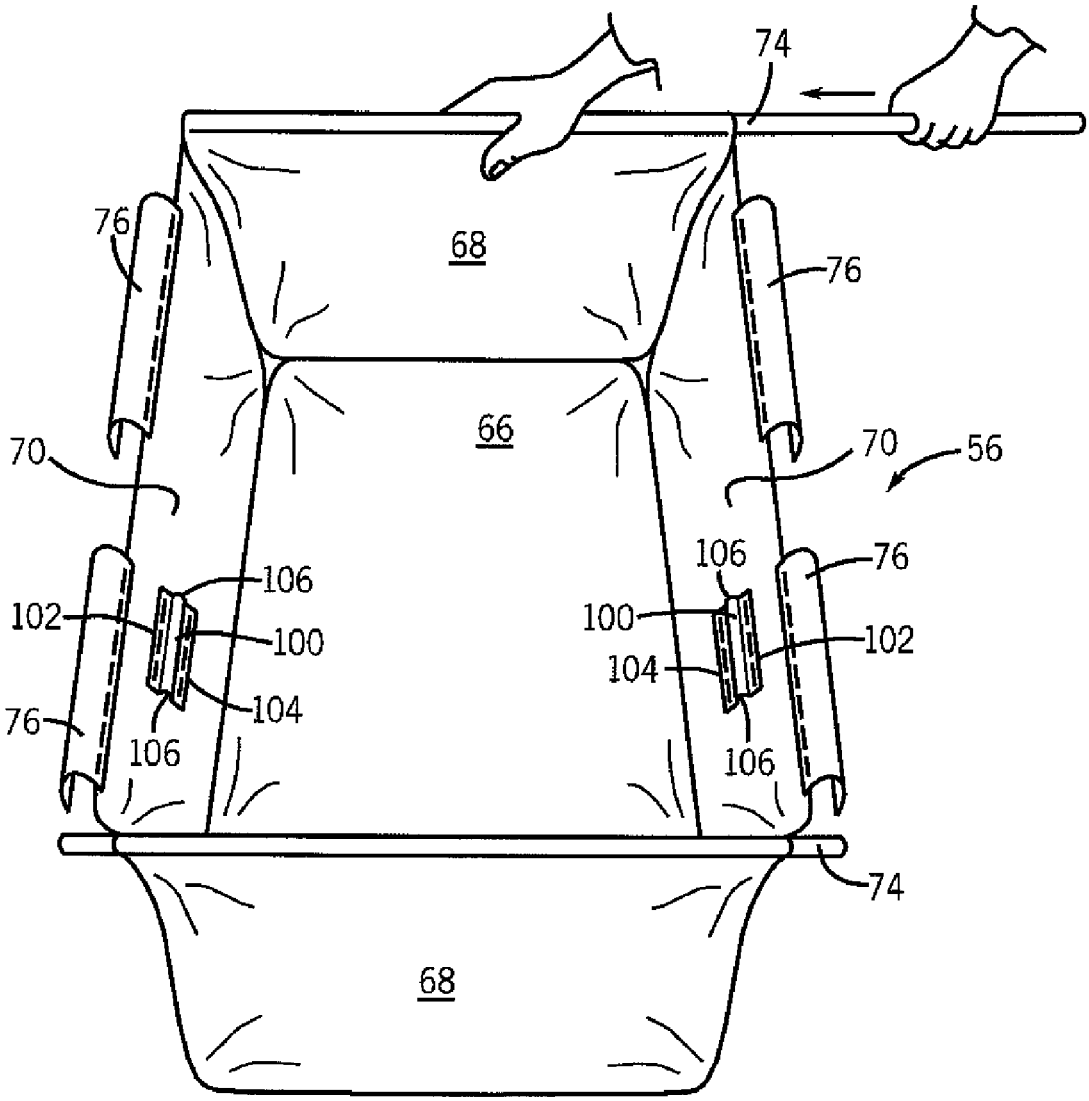
FIG. 2 shows a perspective view of the bassinet of FIG. 1 being assembled prior to installation on the playard.

As shown in FIG. 2, the bassinet 56 can also be constructed in a conventional manner. In this example, the bassinet 56 generally has a bottom panel 66 creating an infant support surface. The bottom panel is surrounded by a perimeter side wall that has a pair of opposed end panels 68 and a pair of opposed side panels 70. In the disclosed example the bassinet 56 is sized essentially to fit the interior of the playard 54. The side panels 70 and end panels 68 thus are generally flush against or adjacent the interior surfaces of the side walls 58 of the playard 54. The side and end panels 70, 68 of the bassinet 56 are significantly shorter than the side walls 58 of the playard 54. As a result, the bottom panel 66 is elevated above the bottom of the base structure 57 when installed.

Figure 3:
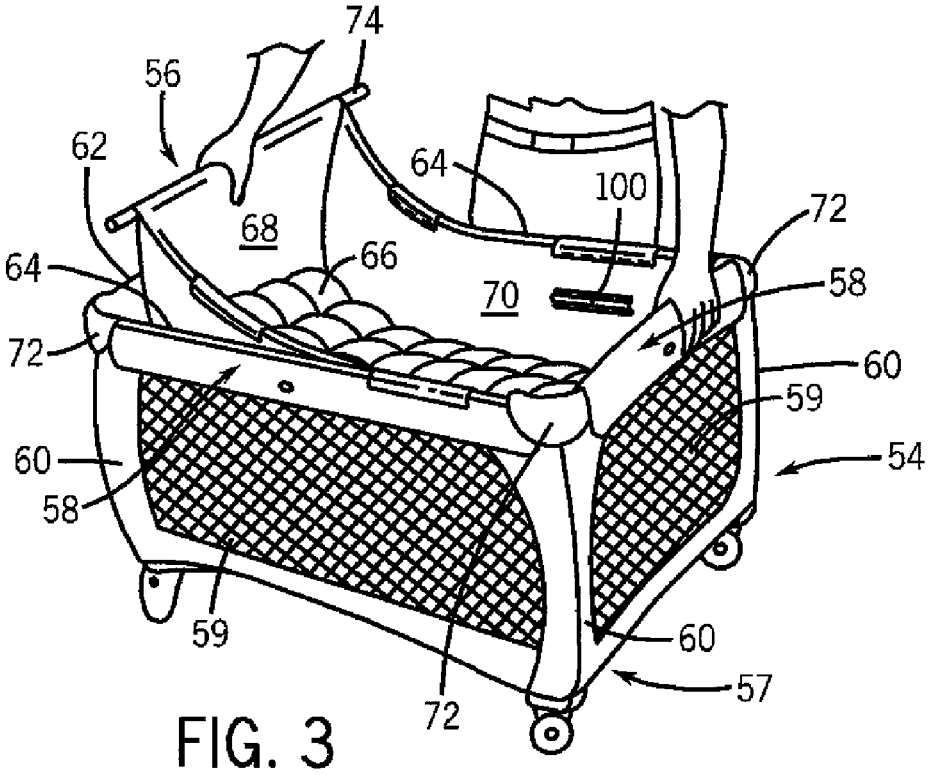
FIG. 3 shows a perspective view of the bassinet of FIG. 2 being installed in the playard of FIG. 1.
Figure 4:
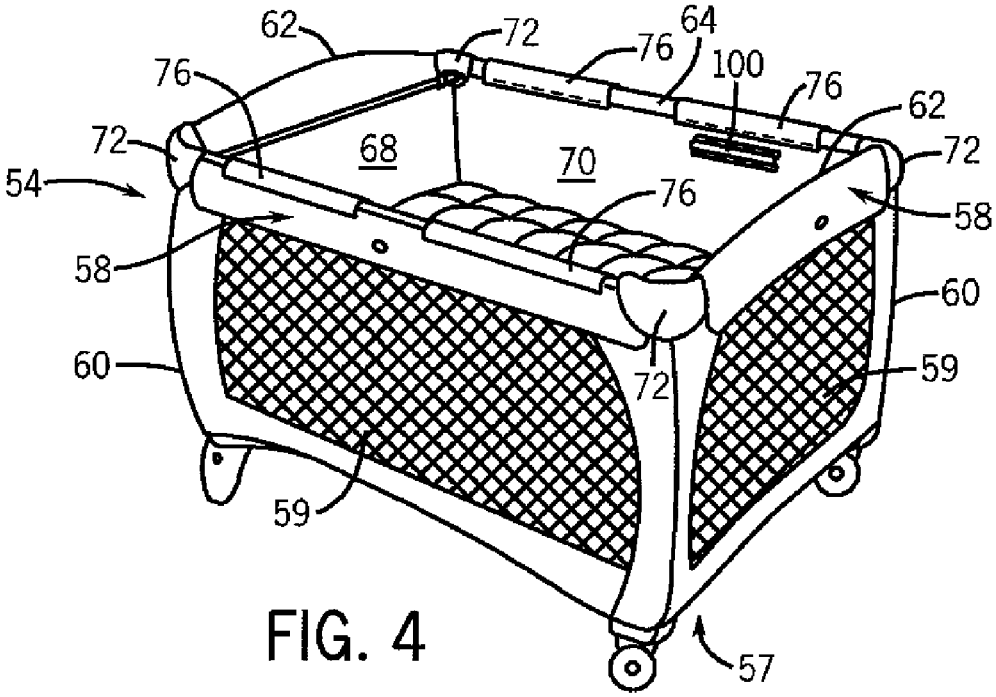
FIG. 4 shows a perspective view of the bassinet of FIG. 3 completely installed in the playard.
Figure 6B:
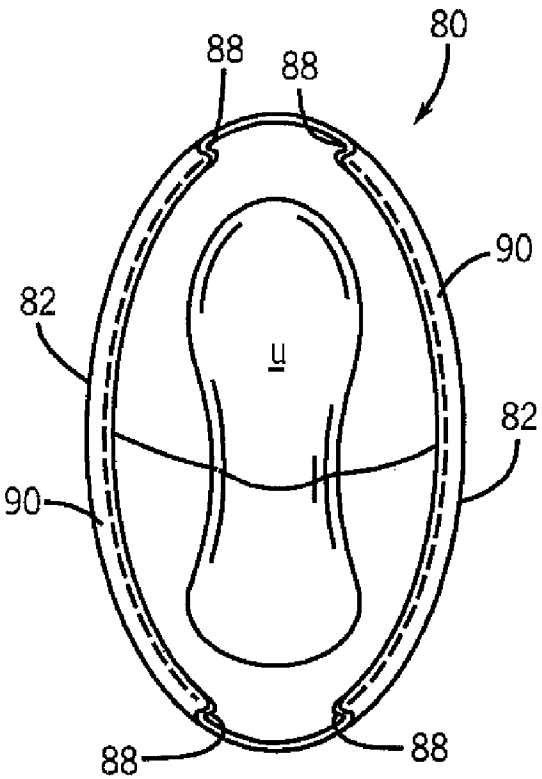
FIGS. 6A and 6B show top and bottom views of the fabric bed of the infant sleeping apparatus in FIG. 1.
Figure 6A:
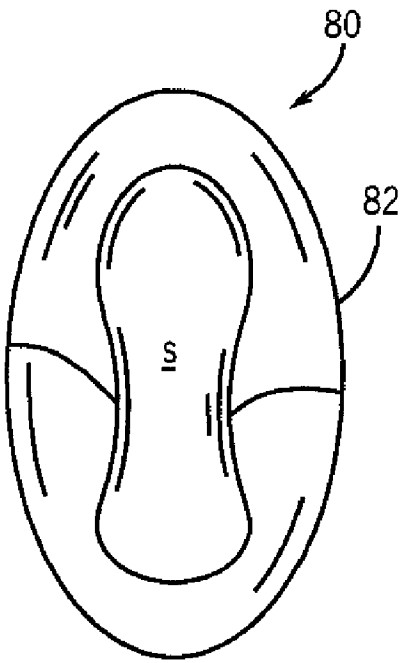

As shown in FIGS. 3 and 4, the playard 54 has a turnbuckle or bracket 72 positioned on each corner post 60 and adjoining the top end and top side rails 62, 64. In the disclosed example, each end panel 68 of the bassinet 56 includes a fabric tunnel or channel at the top of the panel. A support rod 74 is received through each of the channels. When the bassinet 56 is installed, the ends of the rod 74 are exposed beyond the fabric channels on each end of the bassinet (see FIG. 2). The exposed ends of each rod 74 are inserted in receptacles (see FIG. 4), one in each bracket 72 on each end of the playard 54. As shown in FIG. 2, a number of mounting clips 76 are carried on the top edges of the side panels 70 of the bassinet 56. The mounting clips in this example are generally inverted. Elongate, U-shaped hooks that are formed of plastic and sewn to the top edges of the side panels 70. As generally shown, the mounting clips 76 attach to or hook onto the top side rails 64 of the playard 54. When installed, the bassinet is supported around its perimeter by the rods 74 and the several mounting clips 76.

As will become evident to those having ordinary skill in the art upon reading this disclosure, the devices and methods used to install the bassinet 56 on the playard 54 can vary and yet fall within the spirit and scope of the invention. In this example, the number, arrangement, positioning, and configuration of the mounting clips 76 and rods 74 can also vary from the examples shown. The clips 76 in this example are sewn to the bassinet panels. The clips or other devices can attach to the bassinet 56 in other ways within the spirit and scope of the present invention. Similarly, the rods 74 in the disclosed example are removable from the channels in the end panels 68 on the bassinet. However, the rods 74 can be a fixed to the bassinet or can be replaced by other attachment devices at the corners and/or on the end panels 68. The structure and configuration of the bassinet 56 can also vary from that shown. In the disclosed example, the bottom panel 66 and the side and end panels 70 and 68 are formed of a flexible fabric material, can include a stiffening panel, and can include a mattress separate from of including the stiffening panels. Stiffeners, padding, and other features can be added to the bassinet side wall panels and sleeping surface, if desired. Also, a mesh material can be added strategically at locations on the bassinet to provide air flow to the sleeping surface, to effect weight reduction, and the like.

One example of the infant sleeping apparatus 52 is illustrated in FIGS. 5-10. In this example, the apparatus 52 has a fabric bed 80 with a perimeter 82. The apparatus 52 also includes a substantially or generally rigid support frame structure. In the disclosed example, the frame structure has two frame sections 84*a* and 84*b* shown in FIG. 5. The fabric bed 80 generally has a top side or sleeping surface S shown in FIG. 6A and a bottom side or underside U shown in FIG. 6B. The fabric bed 80 also generally has a pair of opposed sides on the perimeter 82 and a pair of opposed ends 86. A fabric tunnel or channel 90 is formed along each side of the perimeter 82 on the underside U of the fabric bed 80. In this example, the fabric channels 90 terminate at open ends 88 near each end 86 of the fabric bed 80. A gap is left between the open ends 88 of the two channels 90 at each end 86 of the bed 80.

Figure 5:
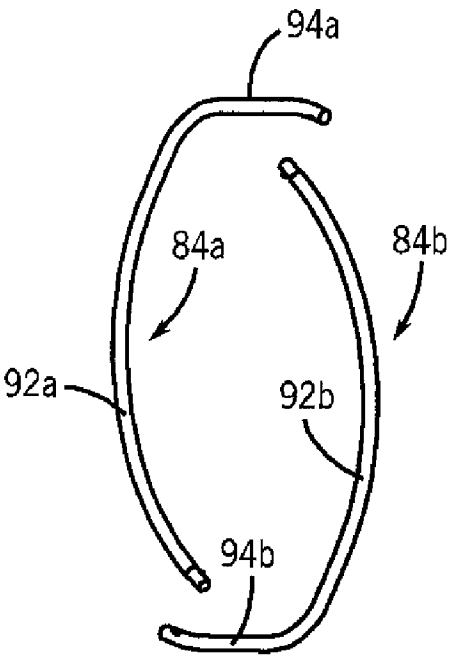
FIG. 5 shows a plan view of the disassembled frame structure of the infant sleeping apparatus in FIG. 1.
Figure 7:
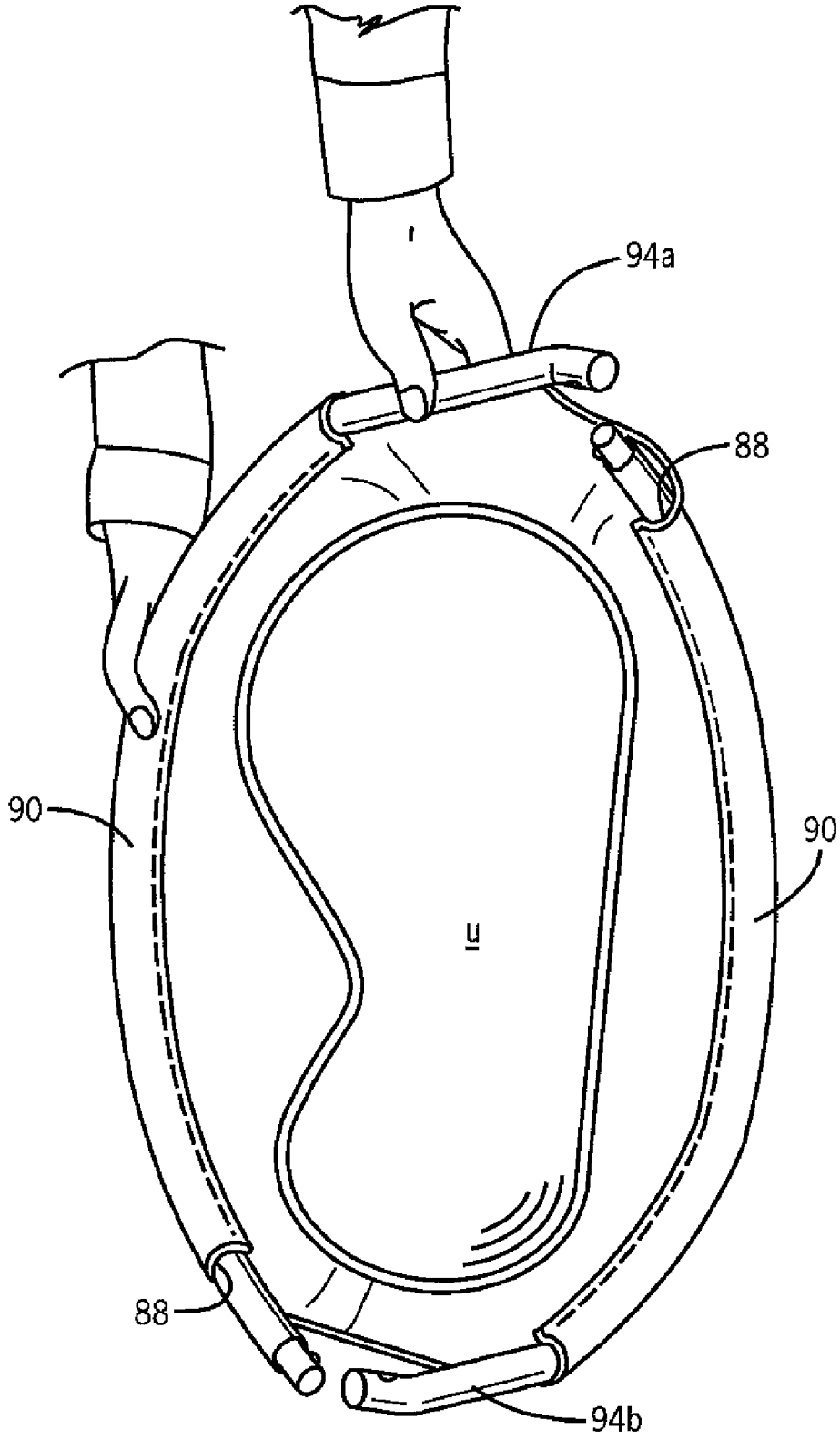
FIG. 7 shows a perspective view of the infant sleeping apparatus with the frame structure of FIG. 5 installed on the fabric bed of FIG. 6.

As shown in FIG. 5, each of the frame sections 84*a* and 84*b* has an elongate side part 92*a*, 92*b* that is curved to match the contour of the perimeter 82 on each side of the fabric bed 80. Each of the frame sections 84*a*, 84*b* also has a generally linear end part 94*a*, 94*b* that is bent or oriented at an angle relative to the respective side part 92*a*, 92*b*. As depicted in FIG. 7, one of the frame sections 84*a* is inserted into one of the channels 90 with the end part 94*a* exposed at one end 86 of the fabric bed 80. The other of the frame sections 84*b* is inserted into the other of the channels 90 with its end part 94*b* exposed at the other end 86 of the fabric bed 80.

In the disclosed example, the infant sleeping apparatus 52 attaches to and is supported by the bassinet 56, which in turn is attached to and supported by the playard 54. The combination of the infant sleeping apparatus 52, the playard 54, and the bassinet 56 create an infant sleeping system in accordance with the teachings of the present invention. In the disclosed example, the infant sleeping apparatus 52 is installed or mounted using a connector arrangement adjacent each end 86 of the fabric bed 80. In this example, a pair of connectors 100 is carried on interior surfaces of the opposed bassinet sidewalls 70. Each of the connectors 100 is a fabric strip sewn to the bassinet side panels 70. Each strip is sewn along its elongate top and bottom edge 102, 104 leaving the opposite ends 106 of the strip open. Each of the connectors 100 is therefore a fabric channel or tunnel carried on opposite facing surfaces within the bassinet 56.

Figure 8A:
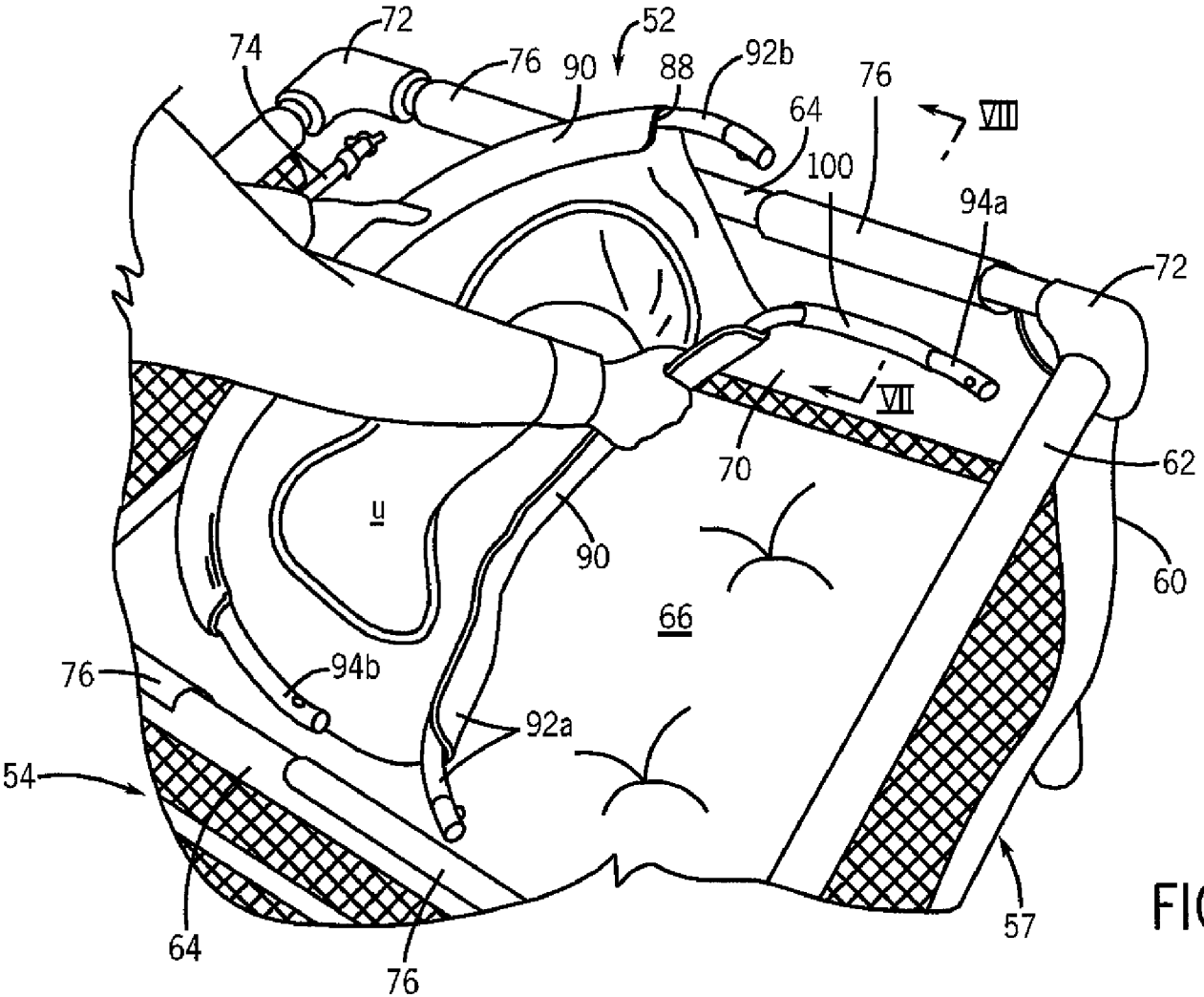
FIG. 8A shows a perspective view of the infant sleeping apparatus of FIG. 7 being installed on the playard and bassinet assembly of FIG. 4.
Figure 8B:
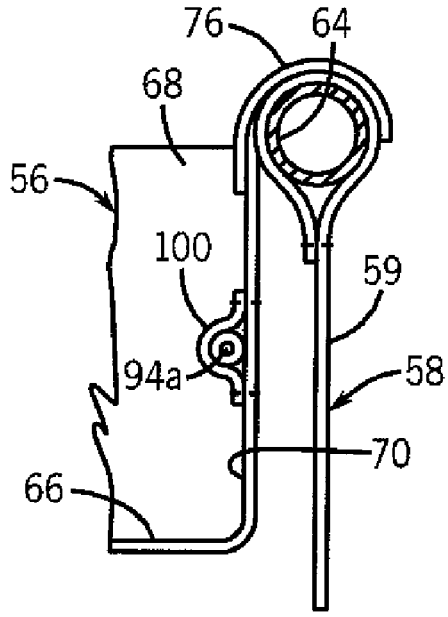
FIG. 8B shows a cross section taken along line VIII-VIII in FIG. 8A of the nearly assembled playard, bassinet, and infant sleeping apparatus.
Figure 9:
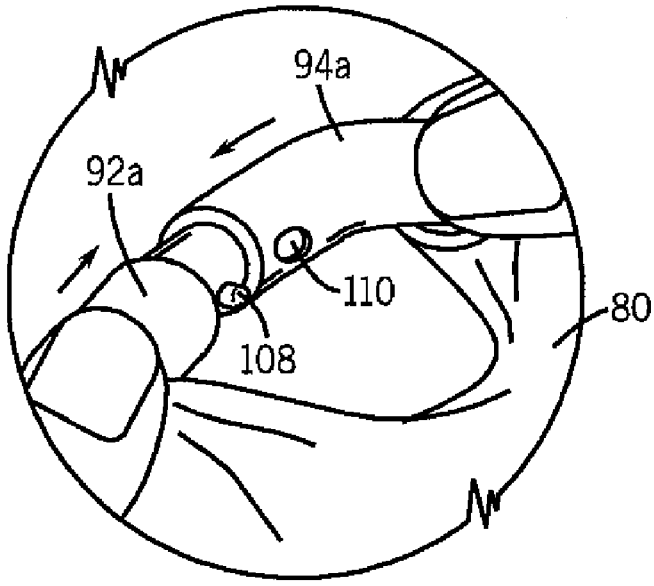
FIG. 9 shows a close up view of the frame structure of FIGS. 5 and 7 being assembled.

To install the infant sleeping apparatus 52 in this example, a caregiver can insert the end part 94*a* of the frame section 84*a* through one of the connectors 100 as shown in FIGS. 8A and 8B. The caregiver can then insert the other end part 94*b* of the other frame section 84*b* through the other of the connectors 100. The frame sections can then be joined together. In the disclosed example, each end of the frame parts is sized and configured to connect with and engage the opposite end of the other frame part to create a loop or hoop shaped frame structure around the perimeter 82 of the fabric bed 80. As depicted in FIGS. 5 and 9, one end of the frame section 84*a* includes at least one resilient spring ball 108 biased outward from a surface of the frame part. The same end of the other frame section 84*b* is similarly constructed. In this example, the spring balls 108 are provided on the free ends of the curved side parts 92*a*, 92*b*. The other end of the frame section 84*a* is sized to telescopically receive therein the spring ball end of the other frame section 84*b*. The other end thus includes a ball receptacle 110 into which the spring ball 108 can snap or seat when the two frame sections are connected. The other end of the frame section 84*b* is similarly constructed to connect with the spring ball end of the frame section 84*a*. In this example, the free ends of the linear end parts 94*a*, 94*b* are sized and configured to receive the spring ball ends. The construction of the frame section ends can be reversed, if desired.

Figure 10:
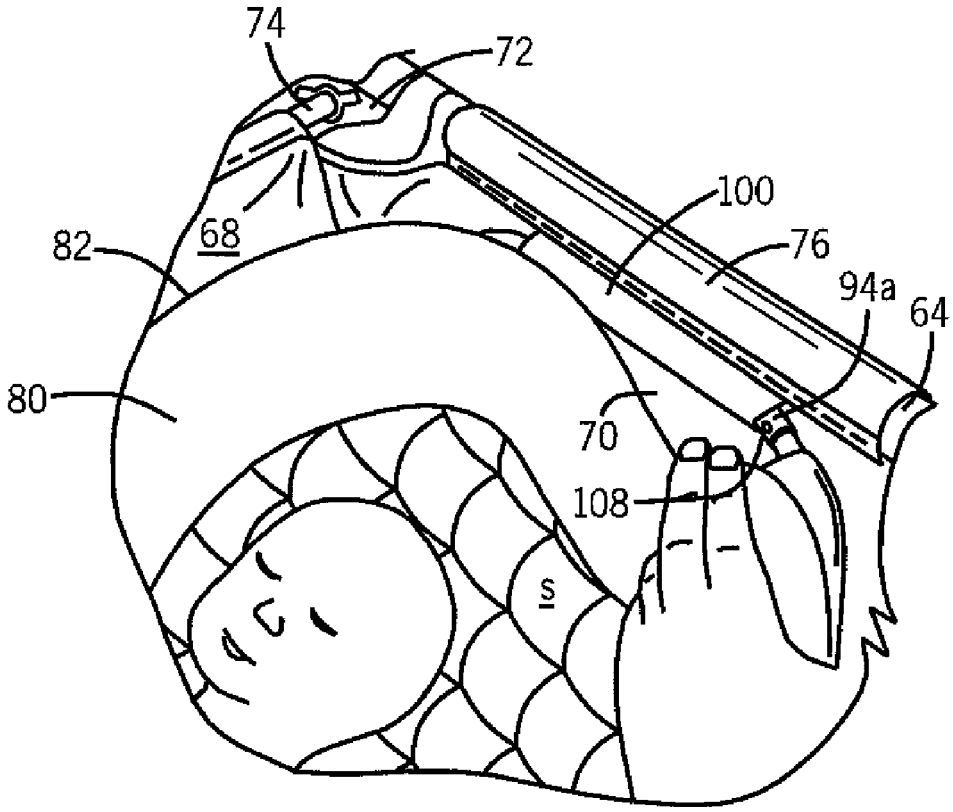
FIG. 10 shows a close up view of one end of the infant sleeping apparatus connector arrangement in FIGS. 8A and 8B after completed assembly and installation.

Once the frame sections 84*a*, 84*b* are coupled to the connectors 100 and then connected to one another, the infant sleeping apparatus 52 is installed and ready for use (see FIG. 10). The connectors 100 and the linear ends 94*a*, 94*b* of the frame sections combine in this example to create the connector arrangement for mounting the infant sleeping apparatus. The fabric bed 80 is suspended from the frame sections 84*a*, 84*b* which in turn are suspended by the connectors 100. Once installed, the underside U of the bed 80 is positioned spaced above the bottom panel 66 of the bassinet 56. However, the bassinet bottom panel 66 is positioned directly below and not far from the infant sleeping apparatus. Thus, an infant that is sleeping on the surface S of the apparatus 52 would only fall a few inches onto the bassinet 56, if the infant were to fall from the sleeping apparatus. The bassinet 56 thus acts as a safety net positioned directly beneath the infant sleeping apparatus 52. An infant sleeping in the bed 80 of the apparatus 52 will tend to be centered in the middle of the bed and enveloped by the fabric material of the bed. The fabric can be sized to sag or droop in the middle, and particularly with the weight of an infant placed on the surface S. The infant sleeping apparatus 52 in this example will thus provide a soothing and comforting sleeping environment for an infant that will cradle the infant as it sleeps.

The apparatus 52 can be disassembled by simply disengaging the frame sections 84*a* and 84*b* from one another in removing the frame parts from the connectors 100. The bassinet 56 is then ready for use, if desired. Similarly, the bassinet 56 can be readily removed from the playard 54 by releasing the rods 74 and mounting clips 76 from the brackets 72 and topside rails 64, respectively. Once the bassinet is removed, the playard 54 is then ready for use, if desired.

Figure 11:
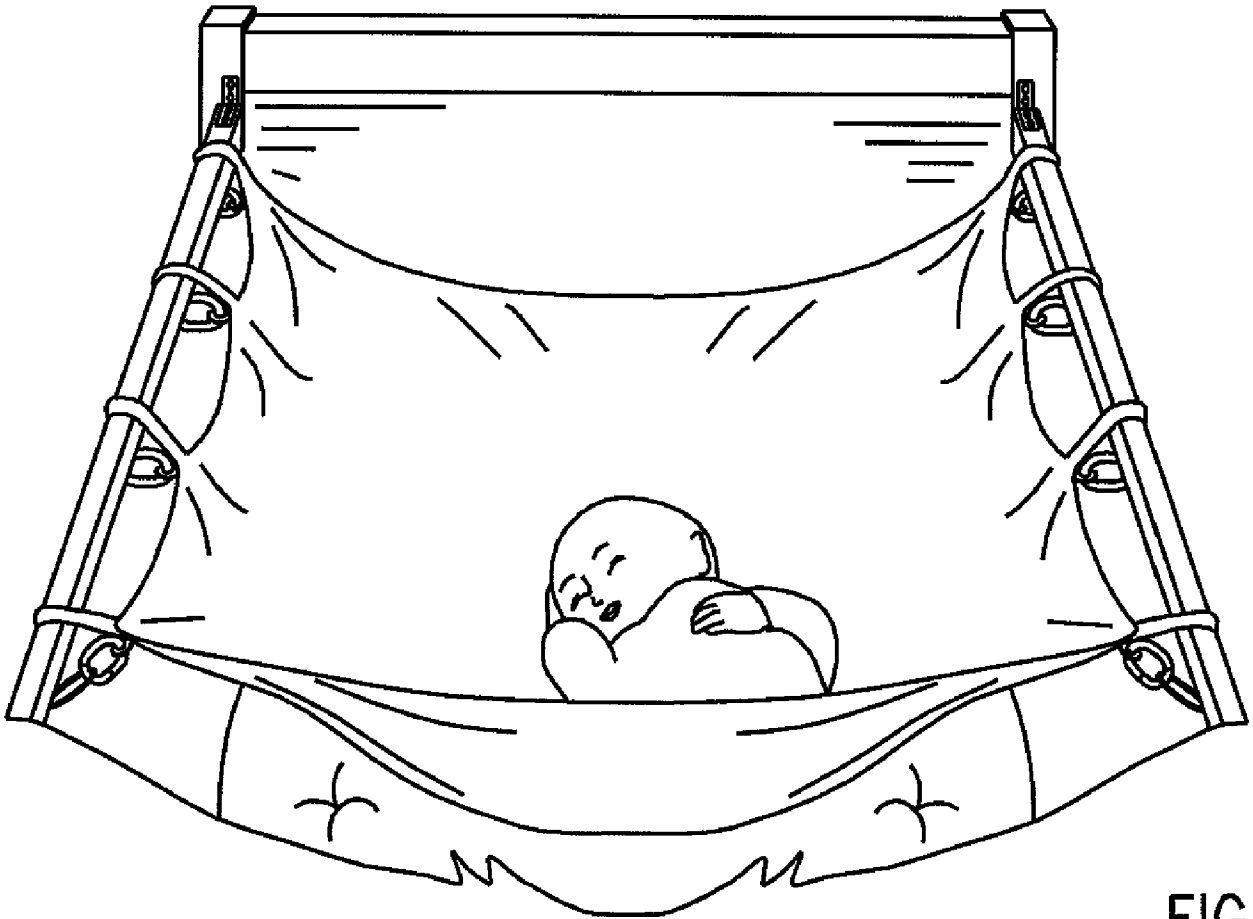
FIG. 11 PRIOR ART
FIG. 11 shows a perspective view of a prior art infant sleeping apparatus installed on a conventional crib.

The playard 54, bassinet 56, and infant sleeping apparatus 52 thus provide a versatile sleeping and play system that can be easily configured and reconfigured according to the needs of a user. The prior art hammock-like sleeping apparatus is shown in FIG. 11. The prior art device is suitable for use on conventional cribs, but is not suitable for use in a versatile sleeping system and is also not suitable for use with a conventional playard having no open rails or sidewalls. Further, the conventional known device is not suitable for use with an intermediate sleeping surface such as a bassinet that can be installed on a crib.

As will become evident to those having ordinary skill in the art upon reading this disclosure, the configuration, position, and construction of the connectors 100, as well as the number and position of the connectors, can vary. In this example, each of the connectors 100 is a continuous fabric strip located opposite the other connector on opposed side panels 70 of the bassinet. In another example, the connectors 100 can be provided as a part of the playard 54, such as on the interior surfaces of the side walls 58. In still another example, the connectors 100 can be provided on opposed end panels 68 of the bassinet. Other configurations and constructions of connector arrangements used to mount an infant sleeping apparatus are within the scope and spirit of the present invention, as will become evident upon reviewing a number of the alternative embodiments disclosed and described below.

Figure 12:
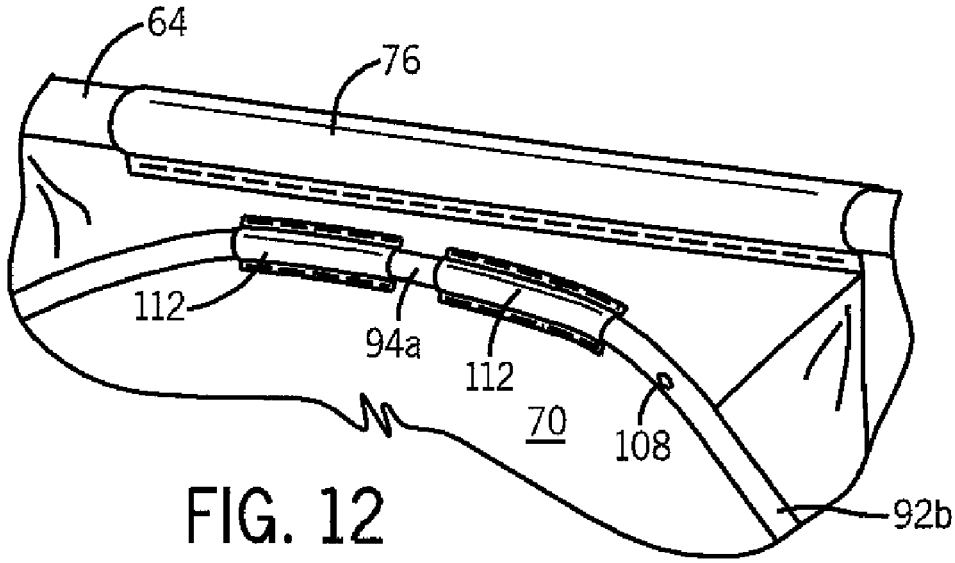
FIG. 12 shows a perspective view of a modification to the connector arrangement of the infant sleeping apparatus of FIG. 1.

As noted above, the devices and methods utilized to install and mount the infant sleeping apparatus in accordance with the invention can vary. In one example shown in FIG. 12, the elongate fabric strip connectors 100 are each replaced by a pair of spaced apart, shorter fabric strips 112 positioned on each bassinet side panel 70. This configuration simply shows that the connectors 100 as previously mentioned can vary from the example described above. A number of alternative examples of infant sleeping apparatus connector arrangements and methods will now be described.

Figure 13:
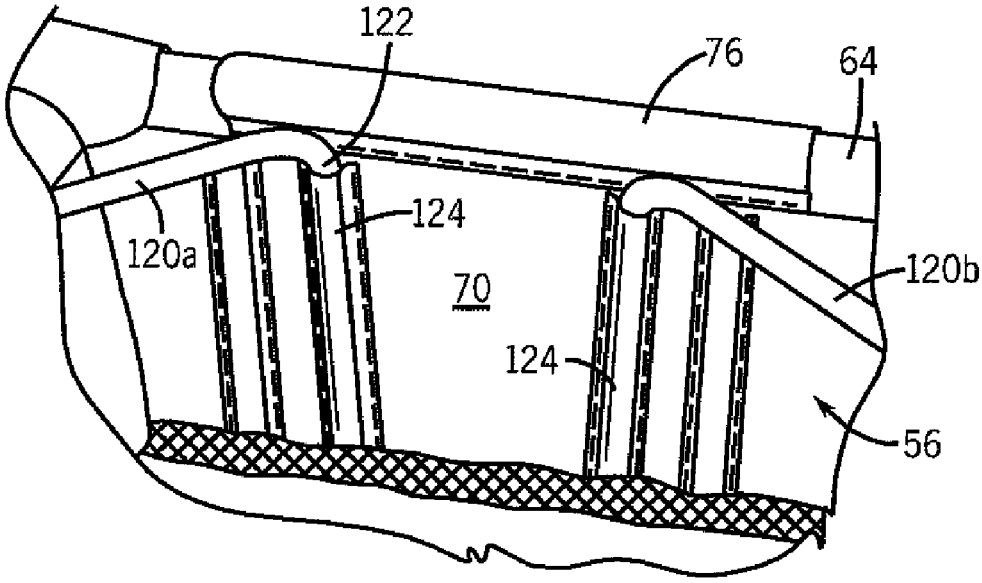
FIG. 13 shows a perspective view of another example of a connector arrangement for an infant sleeping apparatus in accordance with the teachings of the present invention.

One alternative example of an infant sleeping apparatus and connector arrangement is illustrated in FIG. 13. The infant bed 80 in this example has been removed for ease of illustration and description. In this example, the frame for supporting the infant bed includes two frame sections 120*a* and 120*b* that do not connect directly to one another. Instead, each of the frame sections has an elongate side part, similar to the previously described side parts 92*a*, 92*b*, that are received in the fabric channel or tunnel of the bed. In this example, each frame section 120*a*, 120*b* has a downwardly bent leg 122 that is received in a vertically oriented connector 124. As illustrated, the connectors 124 in this example are fabric strips sewn to the bassinet side panels 70 with an open top. The bent legs 122 are inserted downwardly into the connectors 124 for mounting the infant sleeping apparatus to the bassinet 56 in this example. To remove the apparatus in this example, the user need only lift the legs 122 from the connectors 124.

Figure 14:
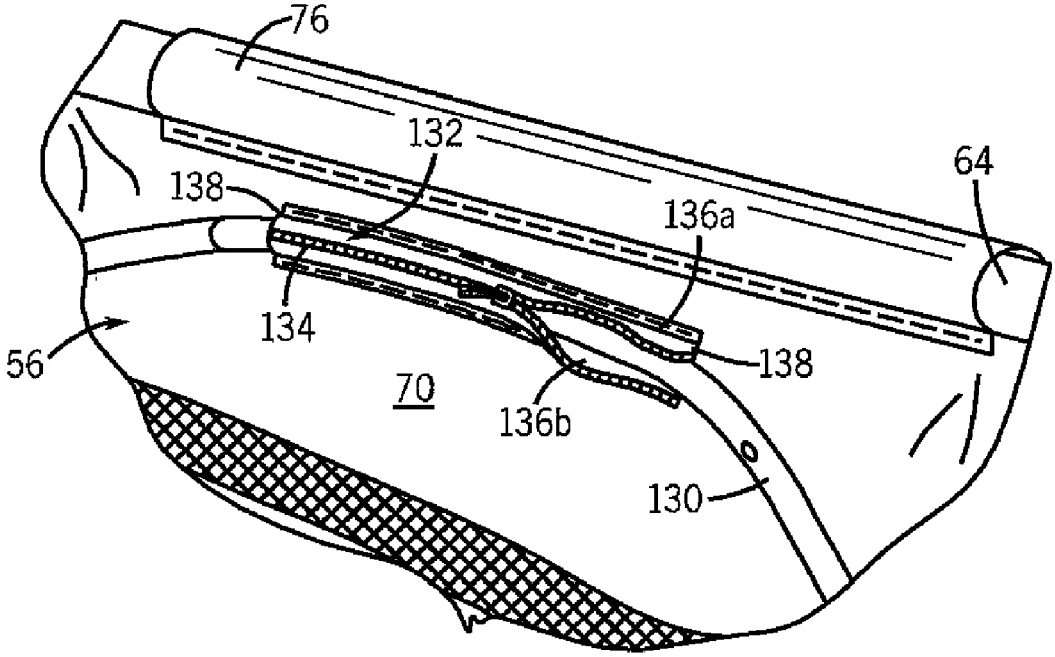
FIG. 14 shows a perspective view of another example of a connector arrangement for an infant sleeping apparatus in accordance with the teachings of the present invention.

Another alternative example of an infant sleeping apparatus and connector arrangement is illustrated in FIG. 14. The infant bed 80 has again been removed in this example for ease of illustration and description. In this example, the frame structure of the infant sleeping apparatus can be a continuous oval hoop or loop 130 of a stiff or generally rigid material. Alternatively, the frame structure can employ sections similar to those described above as frame sections 84*a*, 84*b*. In this example, the connectors 132 are again elongate fabric strips sewn horizontally to the bassinet side panels 70 opposed one another. However, the fabric strips or connectors 132 employ a zipper 134 over the length of the connector permitting the front of each connector to be completely opened, creating two connector flaps 136*a*, 136*b*. Generally linear ends 138 of the hoop 130 can be placed adjacent an opened connector 132 between the flaps. The connector flaps 136*a*, 136*b* can then be reconnected to one another via the zipper 134 to retain and hold the frame or hoop 130 in position for use.

Figure 15:
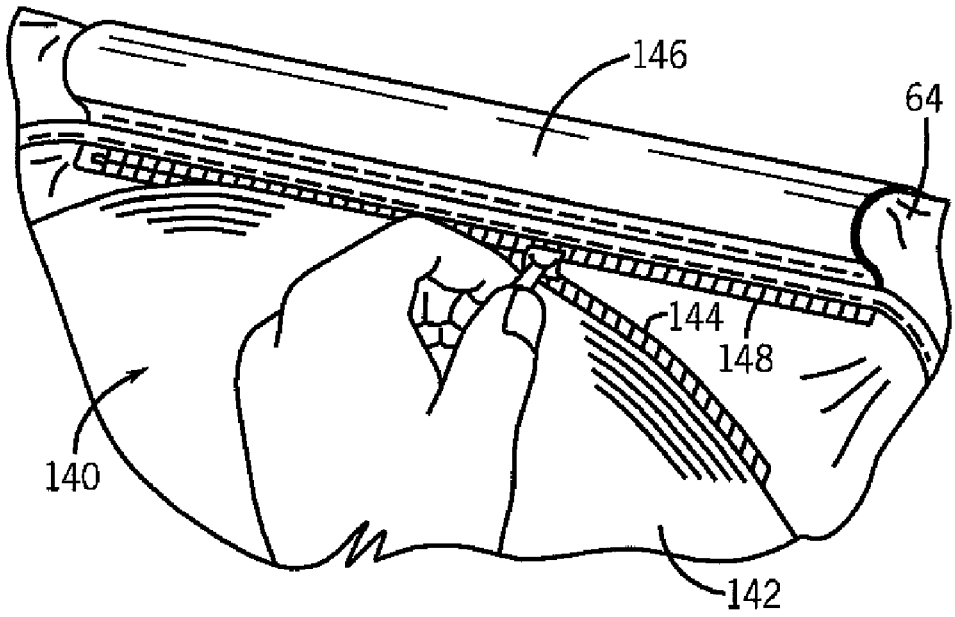
FIG. 15 shows a perspective view of another example of an infant sleeping apparatus in accordance with the teachings of the present invention.

Another alternative example of an infant sleeping apparatus 140 and connector arrangement is illustrated in FIG. 15. In this example, the apparatus 140 includes an alternate fabric bed 142 wherein the channels or tunnels 90 are replaced by a connector portion 144 on each end of the bed. In this example, the connector portions 144 are zipper segments sewn to the fabric material of the bed. Also in this example, the bassinet 56 employs bassinet clips 146 that replace the earlier described clips 76. In this example, the bassinet clips 146 are sewn to the top edges of the bassinet side panel 70 as in the prior example. However, each clip 146 has an exposed mating zipper segment 148 exposed on the interior of the bassinet 56. To install the fabric bed 142 in this example, the user need only connect the fabric bed zipper segments 144 to the mating zipper segments 148 carried on the bassinet clips 146. To uninstall the apparatus 140, the user need only unzip the zipper segments 144, 148.

In this example, the fabric bed 142 can include a perimeter stiffening element such as a frame structure to assist in retaining the shape of the bed and supporting an infant during use. Such a stiffening element (not shown) can be employed to replace the previously described frame sections. The frame structure does not provide an element of the connector arrangement or components for the infant sleeping apparatus 140 in this example and, as a result, does not need to have an exposed portion. The zipper segments 144 and 148 in this example also replace the prior described connectors 100 and frame parts 94*a*, 94*b* that cooperate to mount the infant sleeping apparatus.

Figure 16:
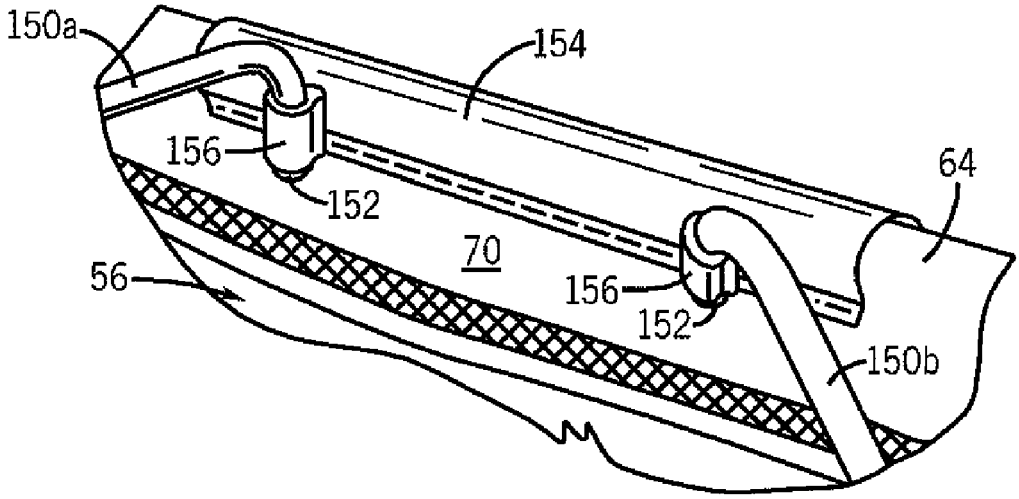
FIG. 16 shows a perspective view of another example of a connector arrangement for an infant sleeping apparatus in accordance with the teachings of the present invention.

Another alternative example of an infant sleeping apparatus and connector arrangement is illustrated in FIG. 16. In this example, the infant bed 80 is again not shown for ease of illustration and description. The infant bed is supported by two frame sections 150*a*, 150*b* that do not connect with one another. The frame sections 150*a*, 150*b* are quite similar, and would function in essentially the same manner, to the frame sections 120*a*, 120*b* of the prior example shown in FIG. 13, except that these frame sections include shorter length down turned legs 152. In this example, the bassinet 56 employs modified mounting clips 154. Each of the clips 154 carries a pair of tubular receptacles 156. Each receptacle 156 is oriented vertically and is sized to receive one of the down turned legs 152 as shown. The connectors in this example are thus the down turned legs 152 and the tubular receptacles 156. The receptacles are carried on the modified bassinet mounting clips 154 instead of on the bassinet side panels 70 as in a number of previous examples.

To remove the infant sleeping apparatus in this example, the user need only lift the legs 152 from the receptacles. In a slightly modified example, the tubular receptacles 156 could be replaced by upward extending pins or projections (not shown) that are received in open or hollow ends of the down turned legs 152. As will become evident to those having ordinary skill in the art, the configuration of the receptacles 156, clips 154, and frame parts 152 can vary from the example illustrated in FIG. 16.

Figure 17:
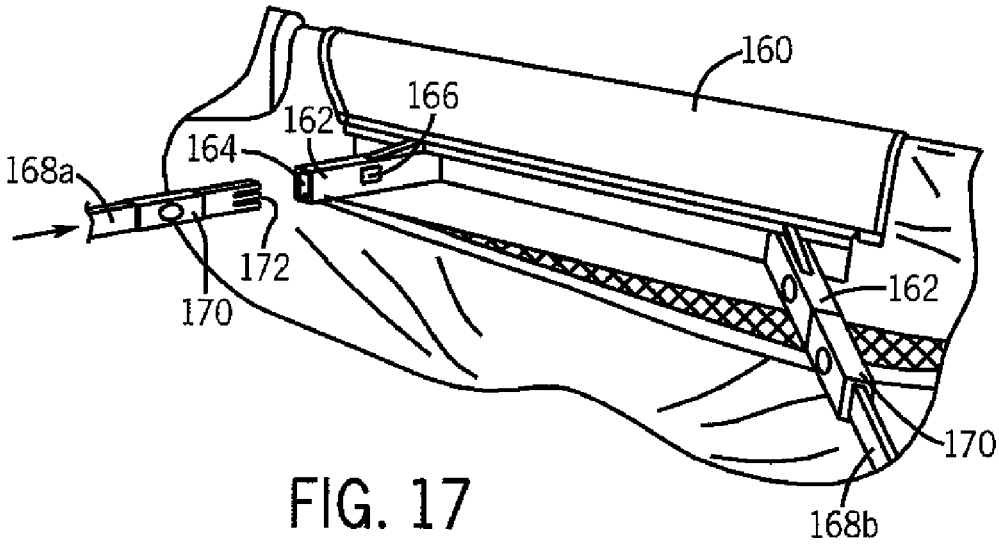
FIG. 17 shows a perspective view of another example of a connector arrangement for an infant sleeping apparatus in accordance with the teachings of the present invention.

FIG. 17 shows another example of an infant sleeping apparatus and connector arrangement that utilizes modified bassinet clips 160. In this example, the infant bed 80 is again not shown for ease of illustration and description. The bassinet 56 in this example employs a pair of opposed modified clips 160 wherein each clip has two forward extending frame connectors 162 projecting from the clips. In this example, the frame connectors 162 on a given clip 160 project from an interior side of the clip and diverge away from one another. In this example, each of the connectors 162 has an open ended receptacle 164 and a catch opening 166 through a side surface of the receptacle. The infant bed 80, though not shown, is supported by a pair of frame sections 168*a*, 168*b*. Each of the frame sections in this example has a latch 170 carried on each end of the frame section. Each latch 170 incorporates a resilient catch 172 with a barb or other catch formation that snaps into the catch opening 166 of a receptacle 164 when installed.

To install the infant sleeping apparatus in this example, the frame sections 168*a*, 168*b* can be slid through the channels or tunnels 90 in the bed 80 with the latches 170 exposed. The latches can be inserted into the corresponding receptacles 164 until the catches 172 snap into or seat within the catch openings 166. To remove or uninstall the infant sleeping apparatus, the user need only push the catches 172 inward against the resilient bias of the part to free the frame sections 168*a*, 168*b* from the receptacles 164. As will become evident to those having ordinary skill in the art, the configuration of the latches 170 and receptacles 168 can vary from the example illustrated in FIG. 17.

Figure 18:
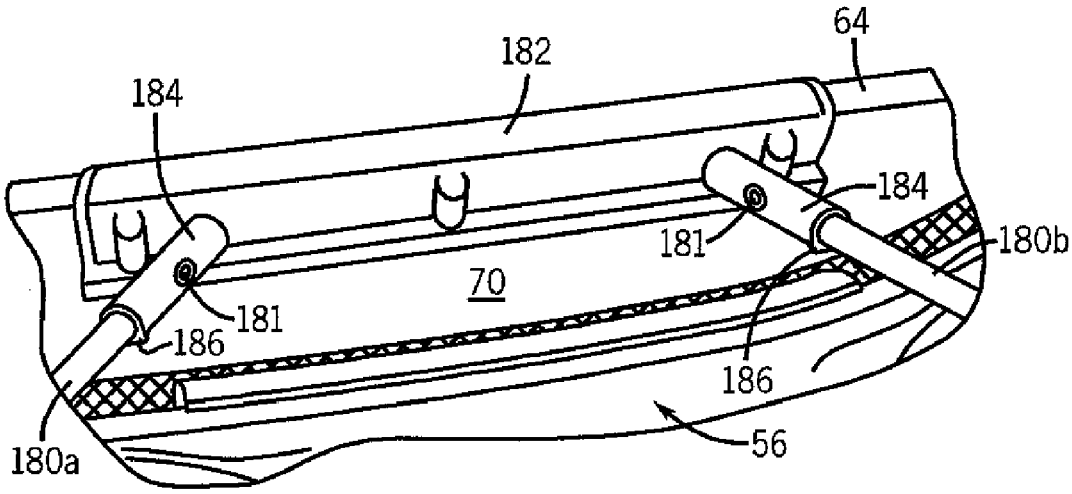
FIG. 18 shows a perspective view of another example of a connector arrangement for an infant sleeping apparatus in accordance with the teachings of the present invention.

To illustrate this point, another slightly modified alternative example of an infant sleeping apparatus connector arrangement is illustrated in FIG. 18. In this example, each of the frame sections 180*a*, 180*b* employs a spring biased ball 181 on a side surface of the frame section near each end. Modified mounting clips 182 are again carried on opposed side panels 70 of the bassinet 56. The clips 182 again employ diverging receptacles 184 projecting from an interior or inner surface of the clips. In this example, each of the receptacles 184 is again open ended. A ball guide 186 can be provided at the opening of each of the receptacles 184 and is positioned to guide one of the spring biased balls of one of the frame sections 180*a*, 180*b* into the receptacle. Each of the receptacles 184 again employs a catch opening 186 through a side surface of the receptacle. When installed, each spring biased ball 181 snaps into one of the catch openings 186 to retain the frame sections 180*a*, 180*b* when installed. To uninstall the infant sleeping apparatus in this example, a user can either forcibly pull each of the frame sections from the receptacles against the spring bias of the balls, or can manually press each of the balls inward and withdrawn the frame section ends to release the frame sections.

Figure 19:
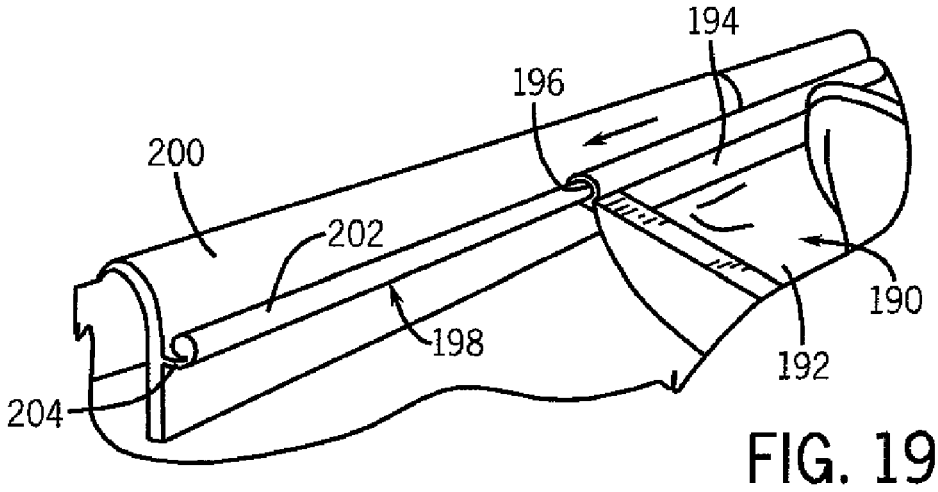
FIG. 19 shows a perspective view of another example of an infant sleeping apparatus in accordance with the teachings of the present invention.
Figure 20:
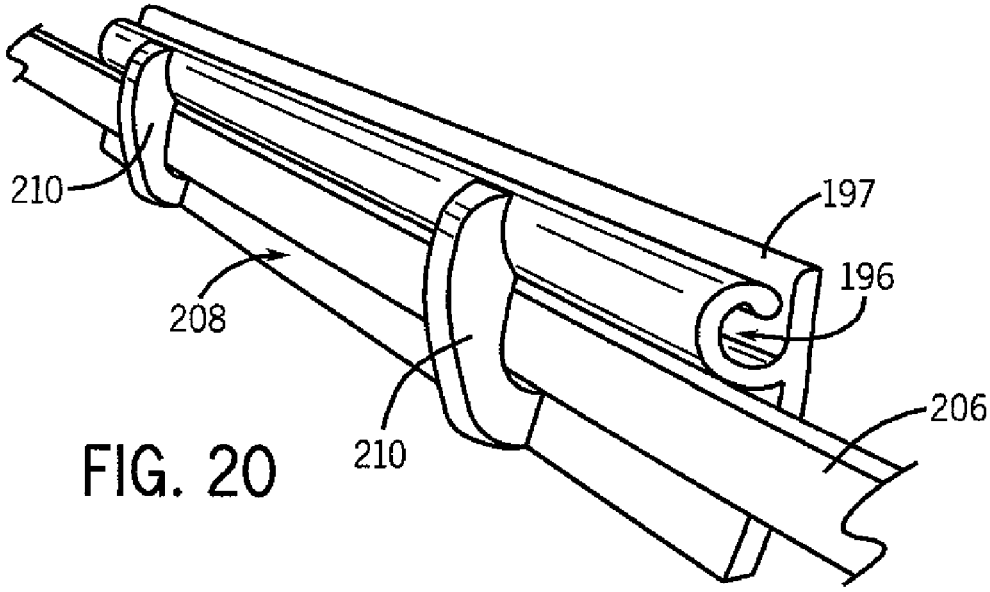
FIG. 20 shows a perspective view of another example of a connector arrangement for an infant sleeping apparatus in accordance with the teachings of the present invention.

Another alternative example of an infant sleeping apparatus 190 and connector arrangement is illustrated in FIG. 19. In this example, the infant sleeping apparatus 190 includes a modified infant bed 192. Each of the two opposed ends of the infant bed employs a first connector part 194 sewn to the fabric material of the bed. In this example, the first connector parts 194 are each an elongate plastic strip with a track or channel 196 extending along an edge of the strip. The tracks or channels 196 (see FIG. 20 also) are open at each end and have an open slot (197 in FIG. 20) extending along the length of the channel or track and facing away from the fabric material of the bed 192. A second connector part 198 is provided on the inner side of each of a pair of opposed modified bassinet mounting clips 200. Each of the second connector parts in this example is formed as an elongate bead 202 of material connected to the respective mounting clip 200 by a flange or stem 204. As shown in FIG. 19, the first connector part carried by the bed 192 can be slid laterally on to the second connector part of the mounting clip 200. In this example, the bead 202 slides into the track 196 via one of the open ends with the flange or stem 204 sliding along the slot of the track.

As will be evident to those having ordinary skill in the art, the connector parts can be formed of materials other than plastic and can take on other configurations and forms. In one example, the track and bead of the connector parts 194 and 198 can be reversed. In another example shown in FIG. 20, the infant bed 192 can employ a perimeter frame structure in the form of a plastic bow 206. The bow can attached to and captured in part of a bed connector part 208, such as a frame track. In this example, the track is created by a plurality of loops 210 projecting from the connector part 208. The connector part 208 can have an open ended track 196 as previously described, which can be slid onto the second connector part 198 carried on a modified bassinet clip 200 as in FIG. 19.

Figure 21:
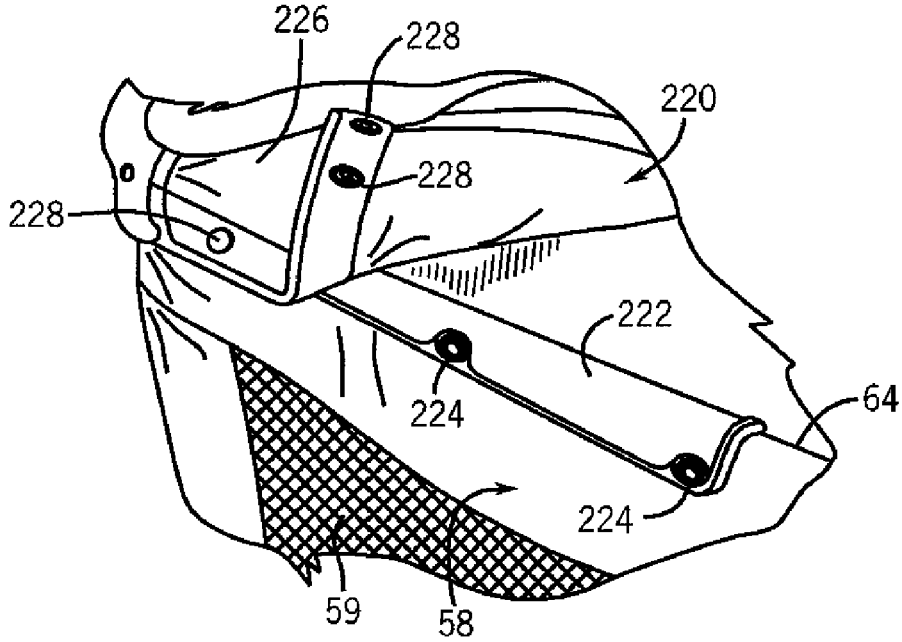
FIG. 21 shows a perspective view of another example of an infant sleeping apparatus in accordance with the teachings of the present invention.

Another alternative example of an infant sleeping apparatus 220 and connector arrangement is illustrated in FIG. 21. In this example, the connector arrangement includes a modified bassinet clip 222 secured to sides of a bassinet 56 as previously described. The modified clip 222 in this example has a plurality of male snap elements 224 projecting from the outside surface of the clip on the exterior of the playard 54. An infant bed 226 in this example has a like number of female snap elements 228 carried on each end of the fabric material of the bed. The infant bed 226 can be installed merely by snapping the male and female snap elements together. Though not shown, the infant bed 226 in this example can employ a perimeter stiffener or frame structure to add stability to the bed when installed. The number and type of male and female snap elements can vary within the spirit and scope of the present invention, and the positioning of the male and female snap elements can be reversed on the bed 226 and modified clip 222, if desired.

Figure 22:
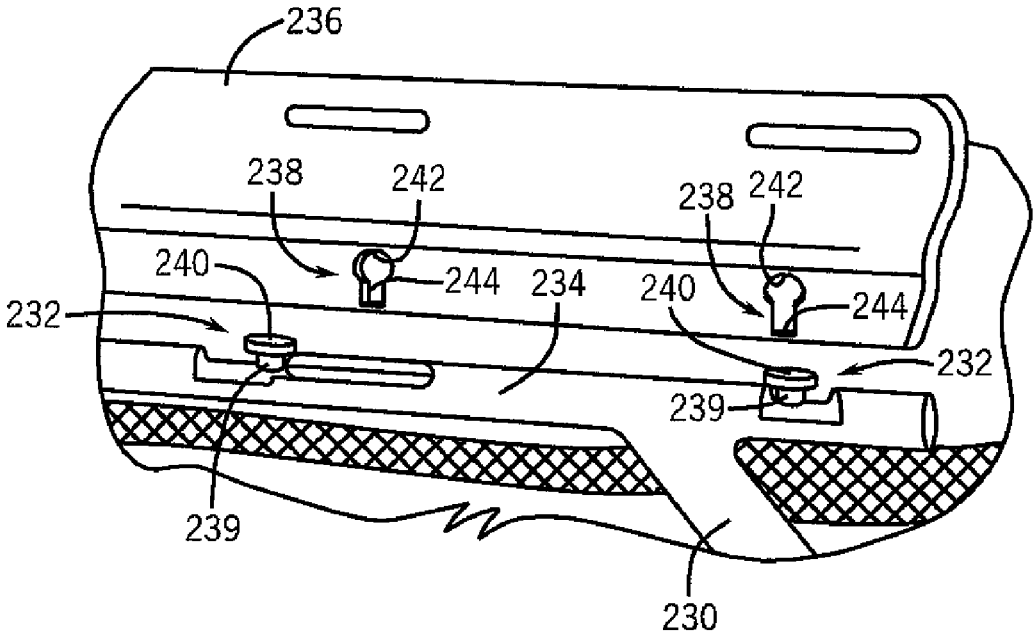
FIG. 22 shows a perspective view of another example of a connector arrangement for an infant sleeping apparatus in accordance with the teachings of the present invention.

Still another alternative example of an infant sleeping apparatus and connector arrangement is illustrated in FIG. 22. The infant bed 80 is not shown in this example for ease of illustration and description. In this example, elongate frame sections 230 are installed through the fabric channels 90 of the bed with ends of each of the frame sections exposed. As shown, each end of each frame section 230 can carry one or more buttons or keys 232 projecting from a first connector part 234 attached to the end of the frame section. The bassinet 56 in this example can again employ modified mounting clips 236, which can be sewn to the bassinet side panels 70. In this example, each of the modified clips incorporates a second connector part 237 with a like number of slotted ways or receivers 238. The ways or receivers 238 are configured to accept the buttons or keys 232 and then to retain engagement or attachment between the two components via gravity. Each of the buttons or keys 232 includes a stem 239 and an oversized head 240 sized to fit in an upper portion 242 of each receiver. Each of the stems 239 of the keys or buttons 232 slides down to a narrower portion 244 of the respective receiver 238. To detach the infant bed from the modified clips 236, the user need only lift the first connector part 234 of the frame sections 230*a*, 230*b* relative to the second connector part 237 to release the keys or buttons 232 from the receivers 238.

As will become evident to those having ordinary skill in the art, the configuration and construction of the first and second connector components in FIG. 22 can also vary from the examples shown. The mating connector components can be configured to snap into place, slide laterally into place, twist and lock, or the like. Also, the frame sections 230*a*, 230*b* can be formed as two separate sections that do not connect to one another, two sections that do connect to one another, or one integral loop shaped frame structure with exposed connector parts.

Figure 23:
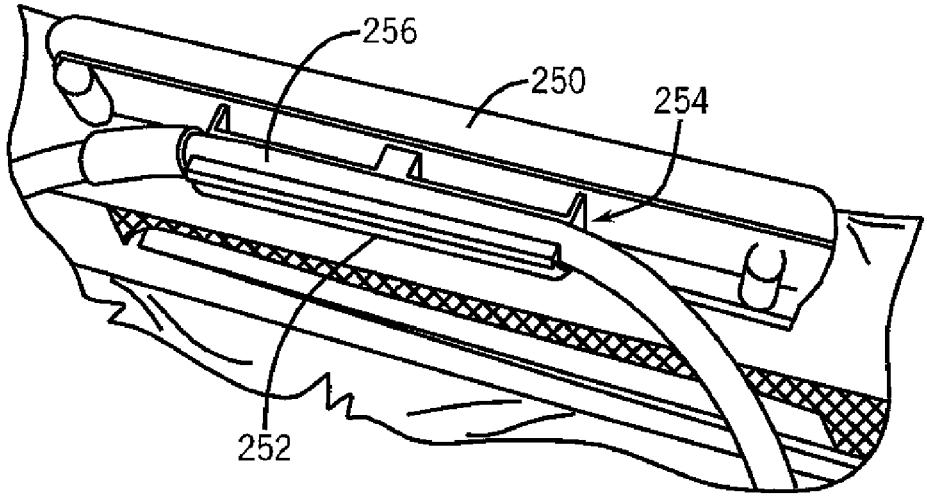
FIG. 23 shows a perspective view of another example of a connector arrangement for an infant sleeping apparatus in accordance with the teachings of the present invention.

Yet another alternative example of an infant sleeping apparatus and connector arrangement is illustrated in FIG. 23. In this example, the infant bed 80 is again not shown for ease of description and illustration. The frame in this example can also be identical to the frame sections 84*a*, 84*b* as previously described with respect to FIGS. 1-10, or can be a continuous loop of material similar to the frame 130 previously described with respect to FIG. 14. In this example, the bassinet 56 again employs a pair of opposed modified bassinet clips 250. Each of the modified clips 250 in this example includes a connector 252 carried on an inner surface of the clip. Each connector 252 is formed as an upwardly open, U-shaped channel 254. A linear portion 256 at each end of the frame structure can be sized to interferingly fit or snap into one of the channels 254. The linear portions 256 of the frame structure can be exposed at the ends of the infant bed 80 and can snap into the channels 254 to install the bed. The linear portions 256 can be popped up and out of the channels 254 to remove the bed.

Figure 24:
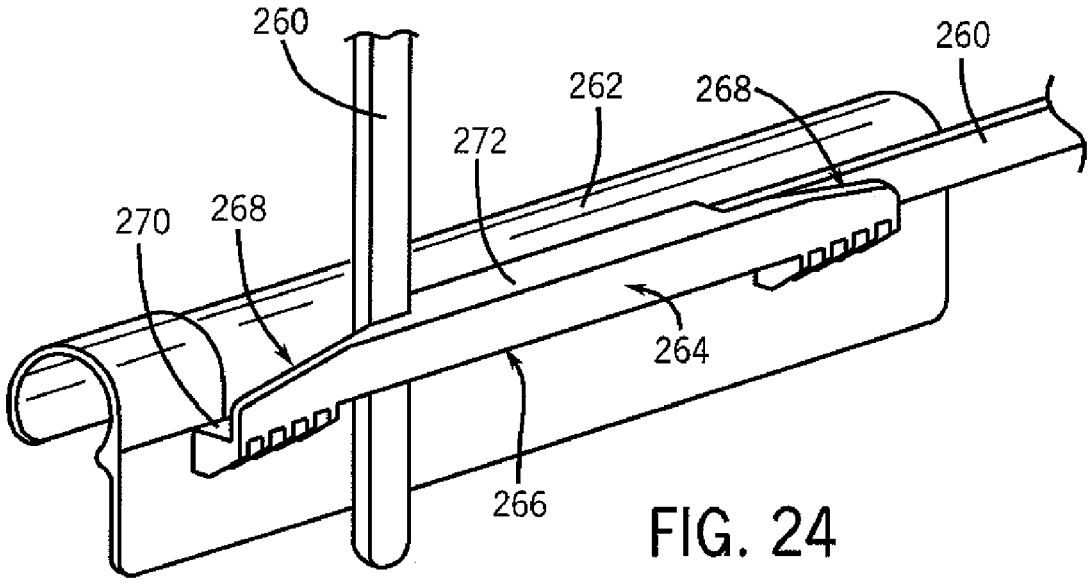
FIG. 24 shows a perspective view of another example of a connector arrangement for an infant sleeping apparatus in accordance with the teachings of the present invention.

Another alternative example of an infant sleeping apparatus and connector arrangement is illustrated in FIG. 24. In this example, the infant bed 80 is again not shown for ease of description and illustration. The infant bed 80 can include a pair of frame sections or stiffener bows 260 with ends exposed beyond each of the fabric channels 90 on the bed. The bassinet 56 in this example can again employ a pair of opposed modified mounting clips 262. Each of the clips 262 carries a connector part 264 on an inner surface. Each of the connector parts 264 in this example includes an elongate tunnel extending a length of the connector. The tunnel has a downwardly open middle portion 266 and a pair of upwardly open end portions 268. A bottom surface 270 of each of the upwardly open end portions 268 is short of the downwardly open middle portion 266 creating a vertical through gap adjacent a top surface 272 of the middle portion. This allows the exposed ends of the stiffener bows 260 to be inserted downward into the through gap as shown in the left-hand side of FIG. 24. The bows 260 can be pivoted downward to a horizontal position as shown in the right-hand side of FIG. 24. The positioning of the surfaces 270 and 272 will retain the bows 260 in a generally horizontal position supporting the fabric bed 80 during use. Though not shown, a detent or snapping structure can be employed to assist in retaining the bows 260 in the installed position and to provide a tactile positive feel for a user during installation of the infant bed.

Figure 25:
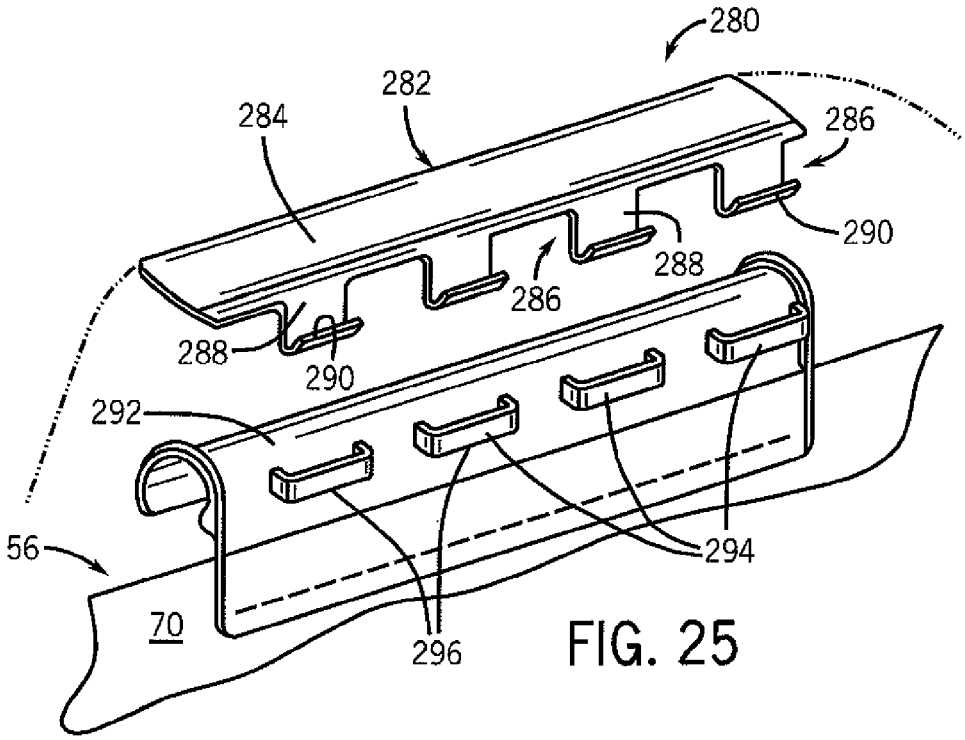
FIG. 25 shows a perspective view of another example of a connector arrangement for an infant sleeping apparatus in accordance with the teachings of the present invention and with the components prior to assembly.
Figure 26:
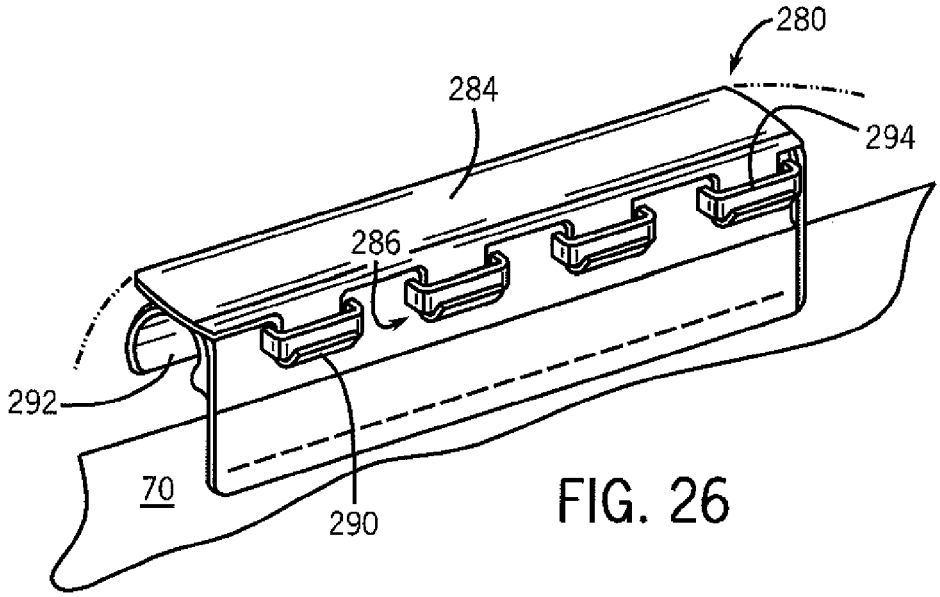
FIG. 26 shows the connector arrangement of FIG. 25 after assembly of the components.
Figure 27:
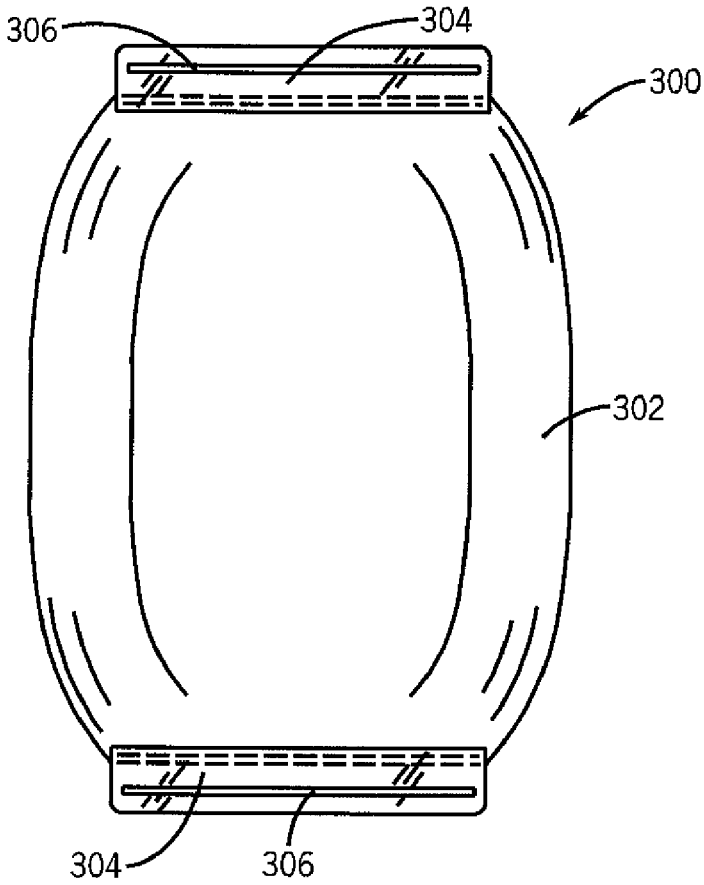
FIG. 27 shows a bottom view of the fabric bed for another alternative example of an infant sleeping apparatus in accordance with the teachings of the present invention.

Still another alternative example of an infant sleeping apparatus 280 and connector arrangement is illustrated in FIGS. 25 and 26. In this example, an infant bed is not shown for ease of description and illustration. The fabric material of the bed in this example would, however, be different from that of the infant bed 80, however, as previously described. In this example, a first connector part 282 has a flange 284 that can be sewn, attached, embedded, or otherwise adhered to an end of the fabric material of the infant bed. One of the connector parts 282 can be applied to each of two opposed ends of the fabric bed. A plurality of connection prongs 286 projects downward from an edge of the flange 284. Each of the connection prongs 286 in this example has a downward depending leg 288 with a detent or catch 290 protruding from a face of the leg on its distal end.

The bassinet 56 in this example employs a pair of opposed modified mounting clips 292. Each clip carries a second connector structure on an inner surface. In this example, the second connector includes a plurality of loops or receivers 294 projecting from a surface of the clip. Each of the receivers 294 in this example has a through opening in a vertical direction that is sized to receive one of the connection prongs 286 in a downward direction as shown in FIG. 26. The detent or catch 290 can be sized to snap through the opening in the receiver 294 or to pivot or rotate into position with the catch caught under a bottom edge 296 of the receiver. To remove the apparatus in this example, the prongs can be snapped up and out of the receivers or pivoted or rotated to release the catches and then lifted from the receivers. As will become evident to those having ordinary skill in the art, the particular number and configuration of the receivers, prongs, legs, and catches can vary from the examples shown and described.

Figure 28:
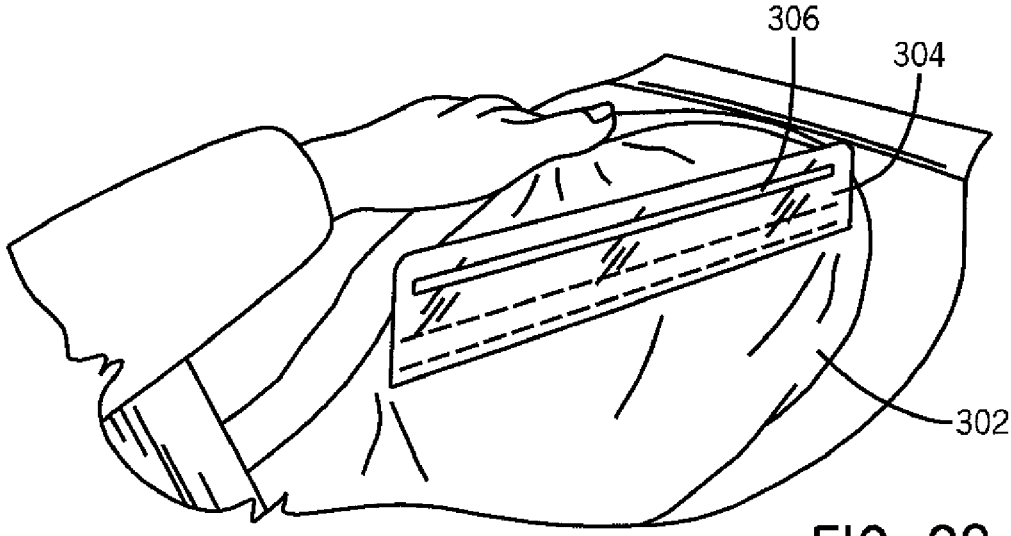
FIG. 28 shows a close up view of one of the connector parts on the bottom of the fabric bed of FIG. 27.

Yet another example of an infant sleeping apparatus 300 and connector arrangement is illustrated in FIGS. 27-31. In this example, the apparatus 300 employees an infant sleeping bed 302 that includes a pair of first connector parts 304 sewn to opposed ends of the fabric material of the bed. In this example, each of the first connector parts 304 is in the form of an elongate plastic strip with a lengthwise slot 306 formed along the strip as best seen in FIG. 28. The apparatus 300 in this example can be employed in the bassinet 56 as previously described, including utilizing the conventional mounting clips 76.

Figure 29:
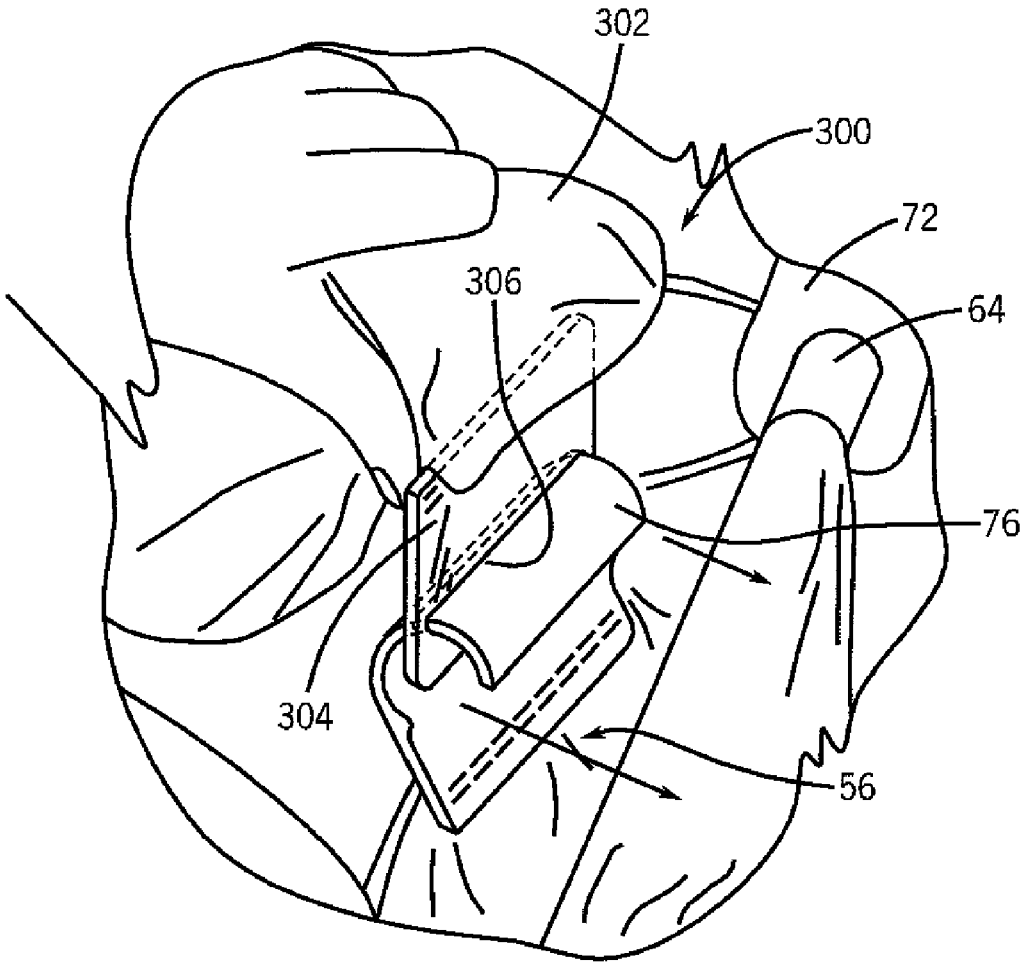
FIG. 29 shows a close up view of the connector part of FIG. 28 being installed on a mounting clip of the bassinet in FIGS. 2 and 3.
Figure 30:
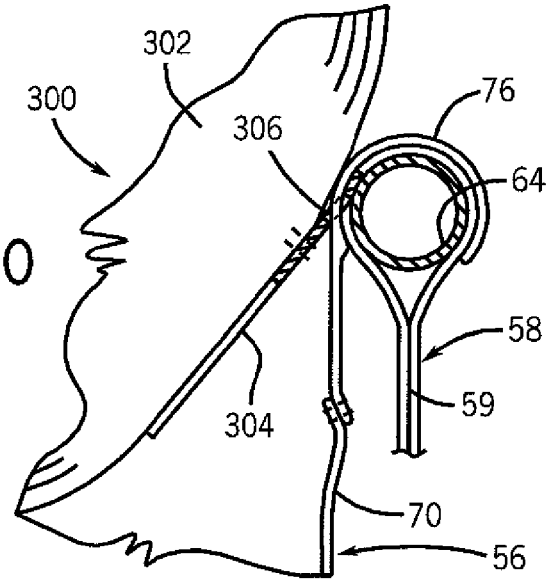
FIG. 30 shows a close up view of the connector part and bassinet clip completely installed on a top rail of the playard in FIGS. 1 and 3.
Figure 31:
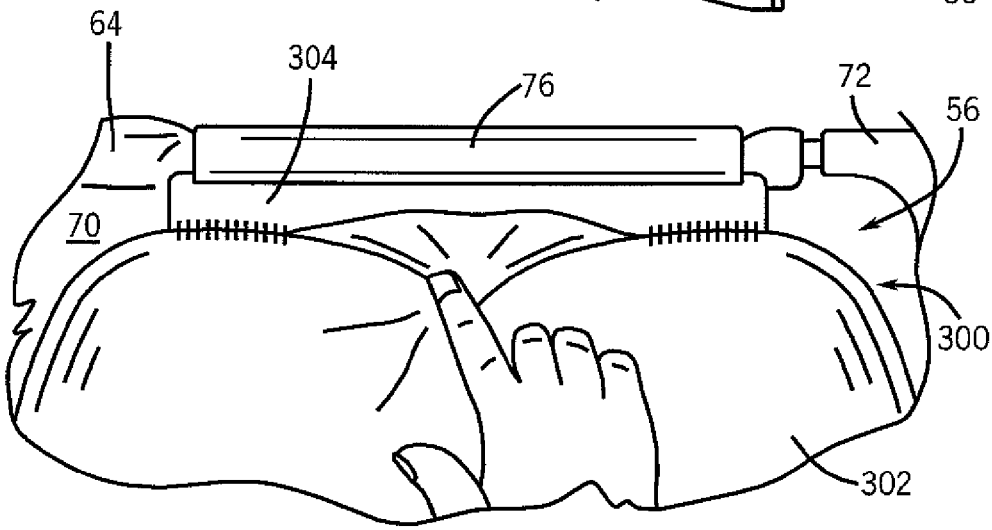
FIG. 31 shows a top plan view of the connector arrangement of FIG. 30.

The infant bed 302 can be installed on a pair of opposed clips 76 on the bassinet prior to complete installation of the bassinet on the playard 54. As shown in FIG. 29, each of the first connector parts can be attached to one of the clips 76 by sliding the free end of the clip through the slot 306 in the first connector part. In this manner, the bassinet clips 76 become the second connector parts for the connector arrangement to install the infant bed 302. The first connector part 304 can be slid from the free end of the clip 76 to the front surface adjacent the joint of the clip to the fabric material of the bassinet side panel 70. Once the two first connector parts 304 are attached to opposed clips 76 of the bassinet, the bassinet can be installed on the playard 54. Each clip 76 can be attached to one of the top side rails 64 of the playard 54 as previously described. As shown in FIGS. 30 and 31, the infant bed 302 will be suspended above the bassinet bottom panel 66. To remove the bed, a user need only remove the two mounting clips 76 acting as the second connector parts and slide the first connector parts 304 from the clips.

As noted previously, the configuration and construction of the infant beds disclosed and described herein can vary within the spirit and scope of the present invention. The materials used to fabricate the bed can also vary, as can the size and shape of the bed. The configuration and construction of the various frame parts disclosed and described herein can also vary. The materials and manufacturing processes used to fabricate the frame parts can vary as well. The frame parts can be hollow metal tubes, solid metal parts, plastic or composite round or flat components, combinations of parts and materials, or the like. The disclosed examples of the invention are not intended to be limited to a particular material selection or manufacturing process for any of the components.

Figure 32:
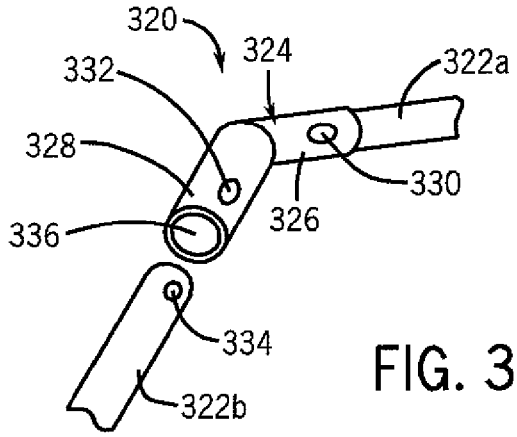
FIG. 32 shows an enlarged view of another example of a frame structure joint for a number of the various infant sleeping apparatus examples disclosed herein.

As one example, FIG. 32 illustrates a frame section joint 320 connecting two frame sections 322*a* and 322*b*. In this example, the joint 320 has a plastic knuckle 324 with a pair of legs 326 and 328 oriented at an angle to one another. The first leg 326 is connected to the end of one of the frame sections 322*a*. The knuckle 324 can be connected to the frame section 322*a* in any number of suitable ways, such as by a rivet 330 as shown. The second leg 328 has a socket or receptacle 332 formed through the surface of the leg. The frame section 322*b* has a spring biased ball 334 projecting from a corresponding surface. The section 322*b* is inserted into the open end 336 of the second joint leg 328 to make the connection.

The invention has been disclosed and described herein as being used with an infant sleeping system that incorporates a playard, a bassinet, and an infant sleeping apparatus. It is possible to configure a playard so that the infant sleeping apparatus can be mounted directly to the playard side walls and or top rails without the use of an intervening bassinet. However, in the disclosed example the bassinet provides the additional feature of creating a safety net directly below the infant sleeping apparatus. The disclosed system offers a child containment solution that can be adapted as a child grows. The infant sleeping apparatus can be used for newborns and infants that are unable to roll over. Once able to roll over, the apparatus can be removed and the bassinet can be used for more mobile infants. Once the infant outgrows the bassinet, the bassinet can be removed and the playard or larger containment structure can be used until the infant becomes a toddler and outgrows the system altogether. The bassinet being positioned under the sleeping apparatus offers a safety net for infants as they transition to being capable of rolling over.

Although certain infant sleeping apparatuses and systems have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child containment system comprising:

a child containment structure having a bottom and a perimeter wall surrounding the bottom, and a connector part carried on each of two opposed inward facing surfaces of the perimeter wall; and an infant sleeping apparatus having a fabric panel with a top surface, a perimeter edge, a frame structure carried near the perimeter edge, and an exposed portion of the frame structure positioned near each opposed end of the fabric panel, wherein the infant sleeping apparatus is removably mounted to the child containment structure with the fabric panel suspended above the bottom of the child containment structure with each exposed portion of the frame structure removably connected to a corresponding one of the connector parts of the child containment structure, and wherein each of the connector parts is a sewn fabric tunnel.

2. The child containment system of claim 1, wherein each exposed portion of the frame structure extends through a respective one of the sewn fabric tunnels.

3. The child containment system of claim 1, wherein each exposed portion of the frame structure extends through the corresponding connector part.

4. The child containment system of claim 1, wherein the frame structure has two frame sections each having a pair of free ends, each of the pair of free ends of each frame section being exposed and coupled to the corresponding connector part but not directly attached to the other of the pair of free ends of the other frame section.

5. The child containment system of claim 1, wherein the frame structure has two frame sections each having a pair of free ends, each of the pair of free ends of each frame section attached to a respective one of the free ends of the other of the two frame sections.

6. The child containment system of claim 1, wherein each exposed portion of the frame has a pair of free ends of the frame exposed at each opposed end of the fabric panel, each of the pair of free ends coupled to a respective one of the fabric tunnels but not directly attached to another free end of the frame on the same opposed end of the fabric panel.

7. A child containment system comprising:

a child containment structure having a bottom surface and a perimeter wall surrounding the bottom surface;

a removable infant sleeping apparatus with a fabric panel having a perimeter, a frame extending around and coupled to part of the perimeter, and exposed portions of the frame on opposed ends of the fabric panel; and fabric tunnels carried on portions of the child containment structure, the exposed portions of the frame coupled to the fabric tunnels such that the fabric panel is suspended over and above a bottom panel of the child containment structure, wherein the frame has two frame sections, each frame section having a pair of free ends each attached to a respective one of the free ends of the other of the two frame sections.

8. The child containment system of claim 7, wherein each of the fabric tunnels is carried on an inward facing surface of the perimeter wall.

9. The child containment system of claim 7, wherein the exposed portions of the frame are inserted through a respective one of the fabric tunnels.

10. The child containment system of claim 7, wherein each of the fabric tunnels is oriented generally horizontally and open at each end, and wherein the exposed portions of the frame extend through a respective one of the fabric tunnels.

11. The child containment system of claim 7, wherein each free end of the pairs of free ends extends through a respective one of the fabric tunnels.

12. A child containment system comprising:

a child containment structure having a bottom and a perimeter wall surrounding the bottom;

connector parts carried on portions of the child containment system; and an infant sleeping apparatus having a fabric panel with a top surface, a perimeter edge, a frame carried near the perimeter edge, and an exposed portion of the frame positioned near each opposed end of the fabric panel, wherein the infant sleeping apparatus is removably mounted to a part of the child containment system whereby each exposed portion of the flame structure is connected to a corresponding one of the connector parts of the child containment system, and wherein the frame has two sections, each frame section having a pair of free ends each coupled to a respective one of the free ends of the other of the two frame sections.

13. The child containment system of claim 12, further comprising a bassinet removably mounted to the child containment structure, the bassinet having a bottom suspended above the bottom of the child containment structure and a side wall surrounding the bottom, wherein the connector parts are carried on the side wall of the bassinet.

14. The child containment system of claim 12, wherein each connector part has a zipper and the exposed portions are connected to the connector parts by the zipper.

15. The child containment system of claim 12, wherein each connector part comprises an upwardly open U-shaped channel and the exposed portions are snapped into a respective one of the channels.

16. The child containment system of claim 12, wherein each connector part comprises one or more buttons, and wherein corresponding receivers located on the exposed portions engaged to and retaining the one or more buttons of a respective connector part.

* * * * *